US009501889B2

(12) United States Patent
Yasaka et al.

(10) Patent No.: US 9,501,889 B2
(45) Date of Patent: Nov. 22, 2016

(54) PRODUCT STORAGE DEVICE

(71) Applicant: FUJI ELECTRIC CO., LTD., Kawasaki-shi, Kanagawa (JP)

(72) Inventors: Yoshio Yasaka, Mie (JP); Michihiko Makino, Mie (JP)

(73) Assignee: FUJI ELECTRIC CO., LTD., Kawasaki-Shi, Kanagawa (JP)

( * ) Notice: Subject to any disclaimer, the term of this patent is extended or adjusted under 35 U.S.C. 154(b) by 0 days.

(21) Appl. No.: 14/419,599

(22) PCT Filed: Sep. 12, 2013

(86) PCT No.: PCT/JP2013/074745

§ 371 (c)(1),
(2) Date: Feb. 4, 2015

(87) PCT Pub. No.: WO2014/046015

PCT Pub. Date: Mar. 27, 2014

(65) Prior Publication Data

US 2015/0213669 A1 Jul. 30, 2015

(30) Foreign Application Priority Data

Sep. 18, 2012 (JP) ..... 2012-204540
Jun. 20, 2013 (JP) ..... 2013-129535

(51) Int. Cl.
*G07F 11/42* (2006.01)
*G07F 11/60* (2006.01)

(52) U.S. Cl.
CPC ..... *G07F 11/42* (2013.01); *G07F 11/60* (2013.01)

(58) Field of Classification Search
CPC ... B65G 47/8884; G07F 11/16; G07F 11/42; G07F 11/10; G07F 11/04; G07F 11/40; G07F 11/28; G07F 11/58; G07F 11/64
USPC ..... 221/251
See application file for complete search history.

(56) References Cited

U.S. PATENT DOCUMENTS 4,705,158 A * 11/1987 Sirvet ..... B21D 43/04 198/463.4
5,209,358 A * 5/1993 Simard ..... A47F 3/002 211/74

(Continued)

FOREIGN PATENT DOCUMENTS

JP S55-57991 A 4/1980
JP 2002-092725 A 2/2002

(Continued)

OTHER PUBLICATIONS

Japan Patent Office, "Decision of a Patent Grant for JP 2014-536816," Sep. 15, 2015.

(Continued)

*Primary Examiner* — Patrick Mackey
(74) *Attorney, Agent, or Firm* — Manabu Kanesaka

(57) ABSTRACT

A product storage device includes: a product rack including a plurality of product storage columns, the product storage column having a product storage path; a main gate member provided the product storage columns to be rotatable in a form of moving into or out of the product storage path; and a restraining unit including a guide member extending along a direction of arranging the product storage columns, and a plurality of piece members slidably housed in a housing region of the guide member. The restraining unit in a normal state restrains all the main gate members from being retreated from the product storage path. The restraining unit allows any one main gate member to be retreated from the product storage path and restrain the other main gate members from being retreated from the product storage path when extraction of a product in the product rack is allowed.

8 Claims, 35 Drawing Sheets

(56) References Cited

U.S. PATENT DOCUMENTS 5,586,665 A * 12/1996 Brousseau ..... A47F 7/285 193/12
5,586,687 A * 12/1996 Spamer ..... A47F 7/285 193/32
5,706,957 A * 1/1998 Hardy ..... A47F 7/285 211/59.2
5,718,341 A * 2/1998 Robertson ..... A47F 7/285 211/59.2
5,788,091 A * 8/1998 Robertson ..... A47F 7/285 211/59.2
5,947,303 A * 9/1999 Robolin ..... A47F 7/285 211/59.2
6,073,785 A * 6/2000 Tolfsen ..... B65G 47/8823 211/183
9,038,852 B2 * 5/2015 Yasaka ..... G07F 11/60 221/1
2002/0066744 A1 * 6/2002 Trulaske, Sr. ..... A47F 7/285 221/295

FOREIGN PATENT DOCUMENTS

JP 2006-164050 A 6/2006
JP 2011-039640 A 2/2011
JP 2013-065191 A 4/2013

OTHER PUBLICATIONS

PCT, "International Search7 Report for International Application No. PCT/JP2013/074745".

* cited by examiner

FIG.18
(a)
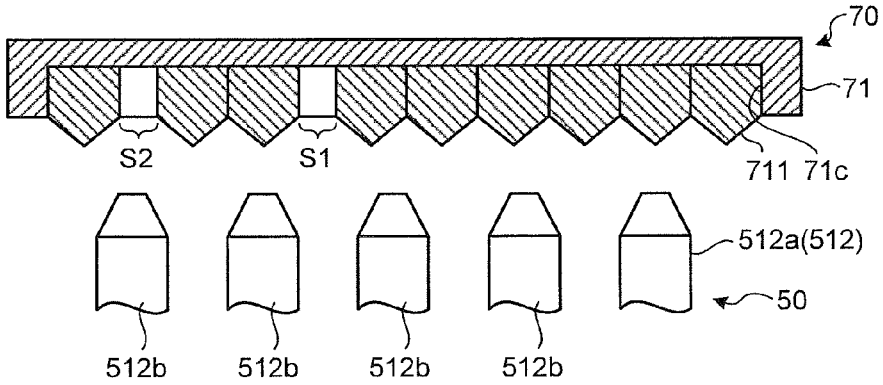
(b)
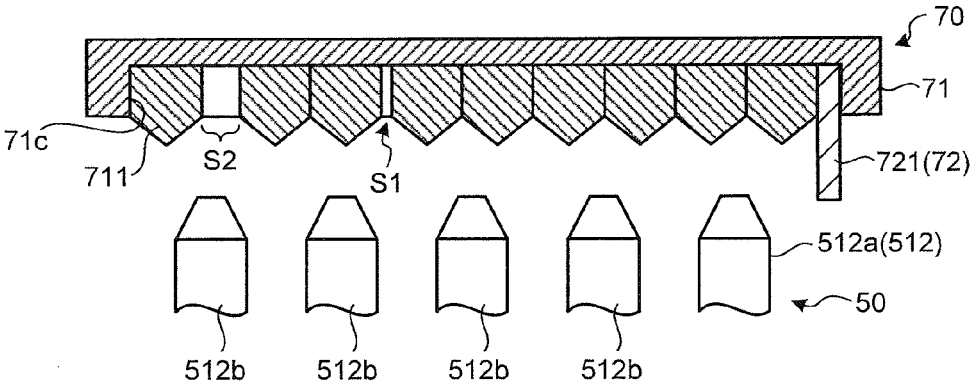
(c)
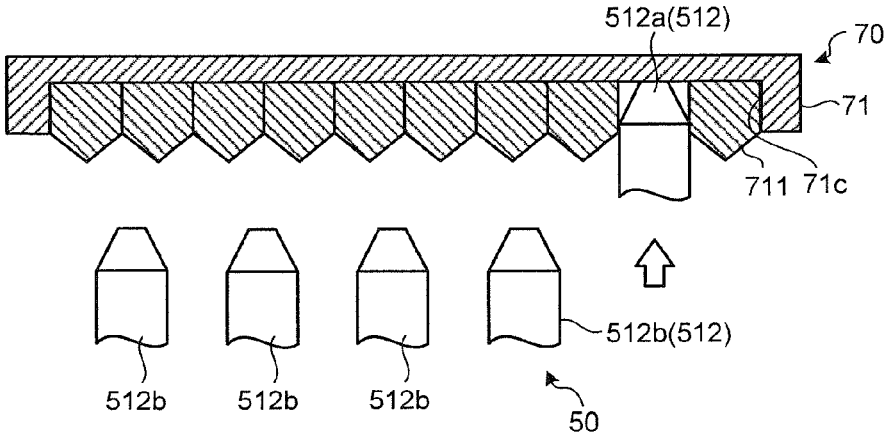

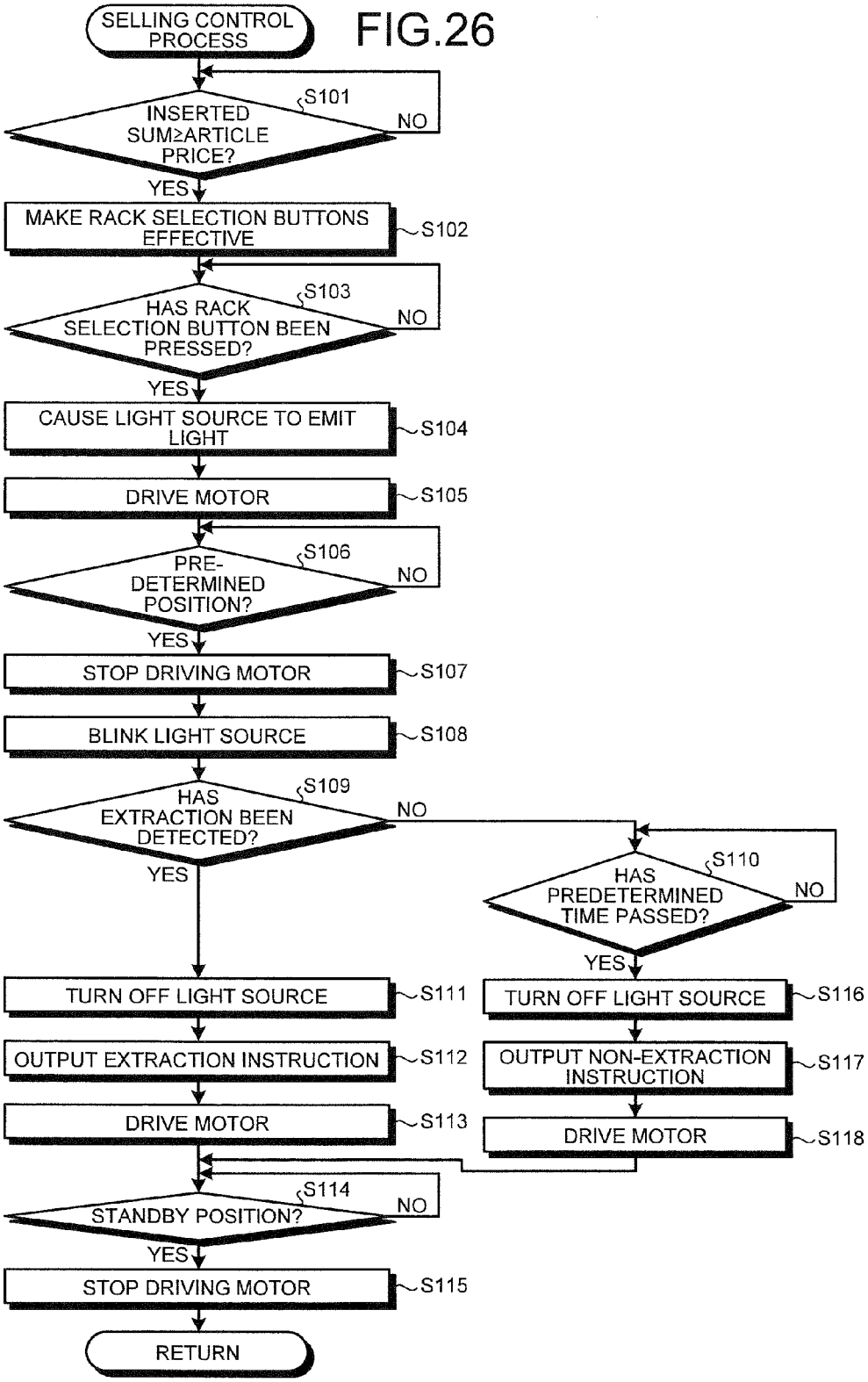
SELLING CONTROL PROCESS
FIG.26
S101
INSERTED SUM≥ARTICLE PRICE?
NO
YES
MAKE RACK SELECTION BUTTONS EFFECTIVE
S102
S103
HAS RACK SELECTION BUTTON BEEN PRESSED?
NO
YES
CAUSE LIGHT SOURCE TO EMIT LIGHT
S104
DRIVE MOTOR
S105
S106
PRE-DETERMINED POSITION?
NO
YES
STOP DRIVING MOTOR
S107
BLINK LIGHT SOURCE
S108
S109
HAS EXTRACTION BEEN DETECTED?
NO
YES
S110
HAS PREDETERMINED TIME PASSED?
NO
YES
TURN OFF LIGHT SOURCE
S111
OUTPUT EXTRACTION INSTRUCTION
S112
DRIVE MOTOR
S113
TURN OFF LIGHT SOURCE
S116
OUTPUT NON-EXTRACTION INSTRUCTION
S117
DRIVE MOTOR
S118
S114
STANDBY POSITION?
NO
YES
STOP DRIVING MOTOR
S115
RETURN

PRODUCT STORAGE DEVICE

RELATED APPLICATIONS

The present application is National Phase of International Application No. PCT/JP2013/074745 filed Sep. 12, 2013, and claims priority from Japanese Applications No. 2012-204540,filed Sep. 18, 2012 and No. 2013-129535, filed Jun. 20, 2013, the disclosure of which is hereby incorporated by reference herein in its entirety.

FIELD

The present invention relates to a product storage device applied to, for example, a vending machine for selling products such as drinks in PET bottles.

BACKGROUND

Conventionally, known vending machines for selling products such as drinks in PET bottles include a product storage device including product storage columns storing products, and a bucket that carries the products. Each product storage column stores a plurality of products in a lined state. When the carrying device is driven, the product storage column pays out the products one by one from its front end part. In an ordinary vending machine, a plurality of product storage columns are arranged side by side along the horizontal direction in a product rack.

The bucket receives a product carried out of the product storage column. The bucket is provided to be movable vertically and horizontally in a region in front of the product rack by a bucket driving unit. The bucket driving unit includes an X-axis carrying mechanism capable of moving the bucket in the horizontal direction, and a Y-axis carrying mechanism that moves the bucket including the X-axis carrying mechanism in the vertical direction.

In the product storage device as described above, the user inserts money of a predetermined sum or more and operates a product selection button, whereby the bucket driving unit is driven to move the bucket to a region in front of the product storage column storing the product that the user desires to purchase. Next, after the product is carried out of the product storage column to the bucket, the bucket is moved close to a product outlet port. This structure enables the user to take out the product through the product outlet port (for example, see Patent Literature 1).

CITATION LIST

Patent Literature

Patent Literature 1: Japanese Laid-open Patent Publication No. 2006-164050

SUMMARY

Technical Problem

The product storage device presented in above Patent Literature 1 indispensably requires driving the bucket driving unit to move the bucket when a product is paid out, and requires various control for moving the bucket. For this reason, the product storage device needs not only an excessive number of components but also an expensive sensor and the like, and causes increase in cost.

In view of the above actual circumstances, the object of the present invention is to provide a product storage device that prevents extraction of a plurality of products by one extracting operation from the product rack, while reduction in cost is aimed.

Solution to Problem

To achieve the above-described object, a product storage device according to the present invention includes: a product rack including a plurality of product storage columns arranged side by side, the product storage column having a product storage path storing products in a row; a main gate member provided in each of the product storage columns to be rotatable in a form of moving into or out of the product storage path, the main gate member in a normal state being maintained in a state of entering the product storage path to be located on a downstream side of a most downstream product, the main gate member allowing the most downstream product to be subjected to extraction operation and extracted when the main gate member is released from the state of entering the product storage path and retreated from the product storage path; and a restraining unit including a guide member extending along a direction of arranging the product storage columns, and a plurality of piece members slidably housed in a housing region of the guide member along the extending direction of the guide member, the restraining unit in a normal state causing an adjusting member to enter the housing region to set a total width of spaces in the housing region smaller than a width of an enterable part of the main gate member and restrain all the main gate members from being retreated from the product storage path, the restraining unit causing the adjusting member to be withdrawn from the housing region to set the total width of the spaces in the housing region greater than the width of the enterable part when extraction of a product in the product rack is allowed, to allow any one main gate member to be retreated from the product storage path and restrain the other main gate members from being retreated from the product storage path.

In the above-described product storage device according to the present invention, the restraining unit moves the guide member to a position in which the guide member is withdrawn from a rotation locus of the enterable part in the main gate member to allow all the main gate members to be retreated from the product storage path when replenishment of products in the product rack is allowed.

the above-described product storage device according to the present invention includes a sub-gate member provided to be rotatable in connection with the main gate member in a form of moving into or out of the product storage path, the sub-gate member being retreated from the product storage path when the main gate member is maintained in the state of entering the product storage path, the sub-gate member entering the product storage path to restrain a second product adjacent to an upstream side of the most downstream product from moving downstream when the main gate member is retreated from the product storage path, wherein the sub-gate member includes a pressing part abutting on the most downstream product to be extracted in a position in which an upper part of the pressing part is inclined upstream, to press the most downstream product downstream when the pressing part enters the product storage path.

In the above-described product storage device according to the present invention, the pressing part of the sub-gate member abuts on the most downstream product when the sub-gate member is retreated from the product storage path.

In the above-described product storage device according to the present invention, each of the product storage columns includes a rail member extending along the product storage path and supporting a product having a neck part between a cap attachment part to which a cap is detachably attached and a body part, in a state of being suspended in a standing position by supporting the cap attachment part of the product, and the rail member is curved in a form where a downstream end part is gradually inclined downward toward downstream.

In the above-described product storage device according to the present invention, the downstream end part includes a restraining part that is narrower than the neck part, and the restraining part in a normal state restrains the most downstream product from passing through the restraining part toward downstream, and the restraining part is elastically deformed to be wider than the neck part to allow passage of the most downstream product by receiving a pressing force from the most downstream product when the most downstream product is subjected to extraction operation.

In the above-described product storage device according to the present invention, the rail member includes: a metal rail base member supporting the products in a state of being suspended substantially horizontally from upstream toward downstream; and a pair of right and left resin lower end rail parts forming the downstream end part and attached to a lower end part of the rail base member, and each of the lower end rail parts is provided to be elastically deformable along the vertical direction with respect to the rail base member.

the above-described product storage device according to the present invention includes a shutter member provided to be rotatable in a form of moving into and out of the product storage path, the shutter member in a normal state entering the product storage path to restrain the second product from moving downstream by urging of an urging unit, the shutter member being retreated from the product storage path against an urging force of the urging unit to allow the second product to move downstream by abutting at an abutting part of the shutter member on the main gate member when the main gate member is retreated from the product storage path.

Advantageous Effects of Invention

In the present invention, a main gate member provided in each of product storage columns to be rotatable in a form of moving into or out of the product storage path enters, in the normal state, the product storage path to be located on a downstream side of a most downstream product, and allows the most downstream product to be extracted when the main gate member is retreated from the product storage path. In addition, a restraining unit including a guide member extending along a direction of arranging the product storage columns and a plurality of piece members slidably housed in a housing region of the guide member along the extending direction of the guide member causes, in a normal state, an adjusting member to enter the housing region to set a total width of spaces in the housing region smaller than a width of an enterable part of the main gate member and restrain all the main gate members from being retreated from the product storage path. By contrast, the restraining unit causes the adjusting member to be withdrawn from the housing region to set the total width of the spaces in the housing region greater than the width of the enterable part when extraction of a product in the product rack is allowed, to allow any one main gate member to be retreated from the product storage path and restrain the other main gate members from being retreated from the product storage path. This structure enables restraint of extraction of a plurality of products by the user by one extracting operation, without any bucket driving unit used in conventional product storage devices, when selling in the product rack is allowed. Accordingly, the structure produces the effect of preventing extraction of a plurality of products from the product rack by one extracting operation, with reduction in cost aimed.

BRIEF DESCRIPTION OF DRAWINGS

FIGS. 18(*a*) to 18(*c*) are explanatory drawings, each schematically illustrating a main part of a restraint mechanism forming the product storage device serving as the embodiment of the present invention.

FIG.

FIG. 26 is a flowchart illustrating main processing details of a selling control process executed by the controller illustrated in FIG. 2.

DESCRIPTION OF EMBODIMENTS

Preferred embodiments of the product storage device according to the present invention will be explained in detail hereinafter with reference to attached drawings.

Figure 1:
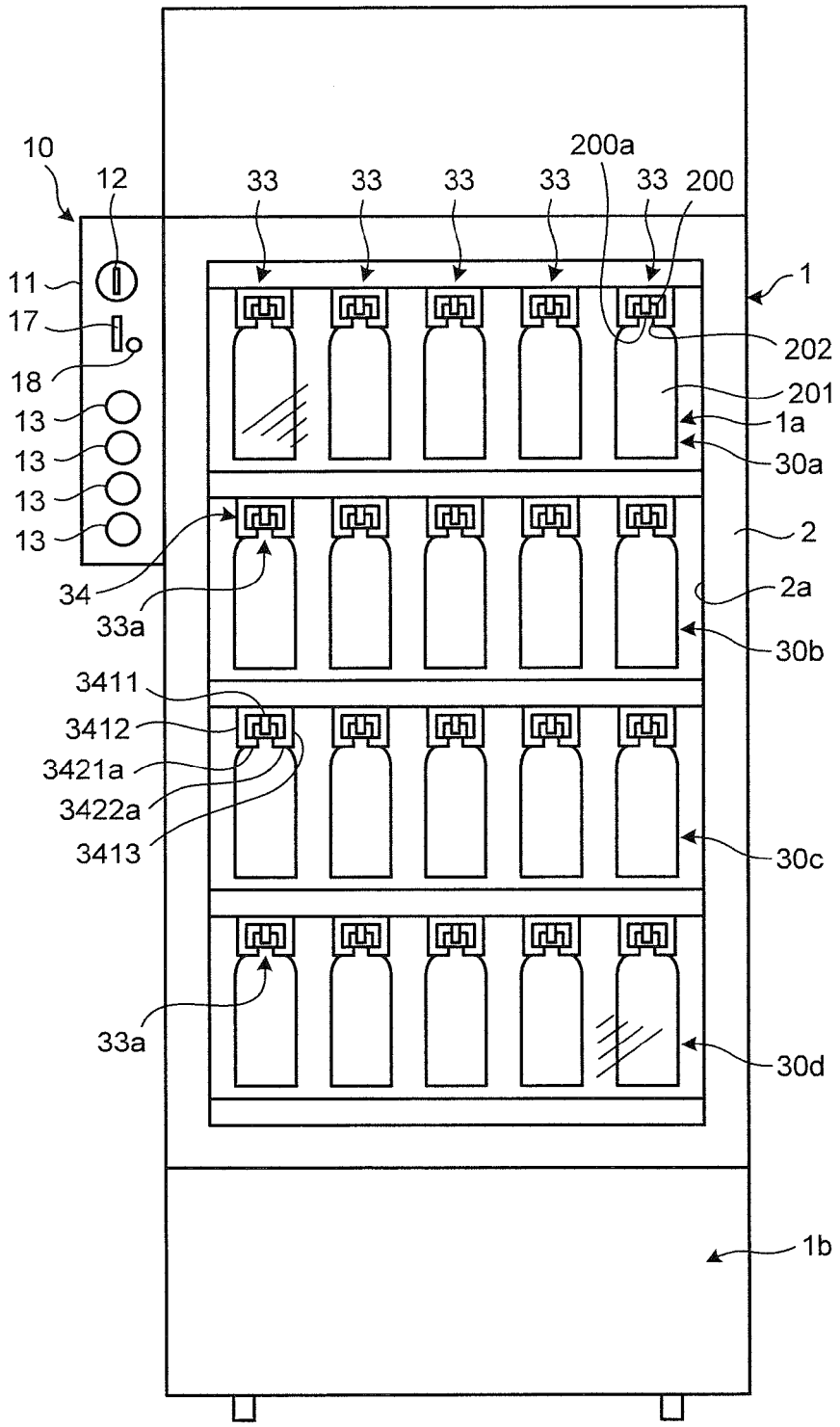
FIG. 1 is a front view illustrating a vending machine to which a product storage device serving as an embodiment of the present invention is applied.
Figure 2:
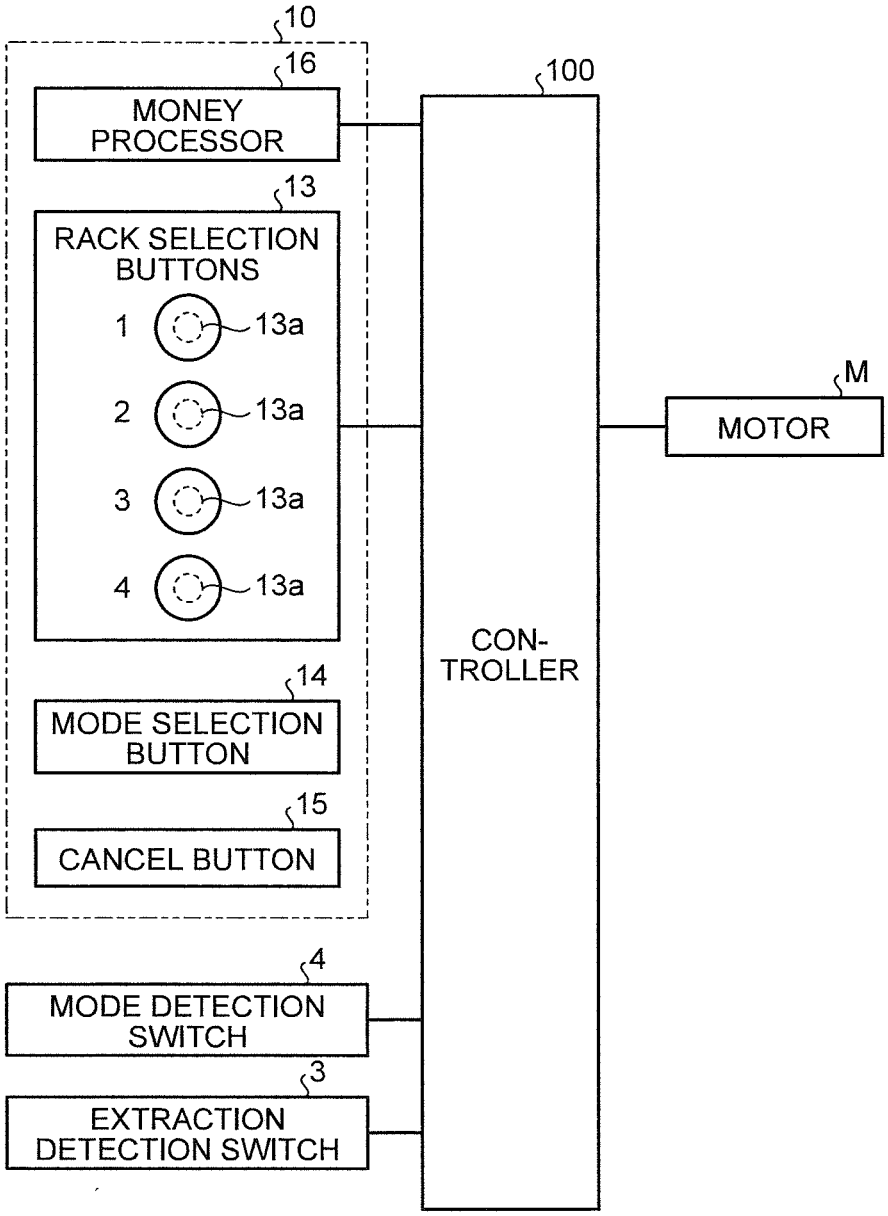
FIG. 2 is a block diagram illustrating a control system of the vending machine to which the product storage device serving as the embodiment of the present invention is applied.

FIG. 1 and FIG. 2 illustrate a vending machine to which the product storage device serving as an embodiment of the present invention is applied. FIG. 1 is a front view of the vending machine, and FIG. 2 is a block diagram illustrating a control system thereof. The vending machine illustrated herein sells products such as canned drinks and drinks in PET bottles in a cooled or heated state, and includes a main cabinet 1.

The main cabinet 1 is a housing having a rectangular parallelepiped shape and having an opening formed in a front surface thereof and opened and closed by an external door 2. The external door 2 is formed with proper use of a heat insulating material, and has a window part 2*a* that is formed by fitting a transparent plate material such as heat insulating glass. Accordingly, the inside of the vending machine can be viewed through the window part 2*a* of the external door 2. A handle that is not illustrated is provided in a central part of the left side surface on the left end side of the external door 2.

The inside of the main cabinet 1 is divided into two, that is, an upper part and a lower part, the upper part serves as a storage chamber 1*a*, and the lower part serves as a machine chamber 1*b*. The storage chamber 1*a* is a chamber having an inside maintained at a preset temperature, and each of wall members forming the storage chamber 1*a* is formed of an insulating material. The storage chamber 1*a* is provided with a unit (not illustrated) for cooling the internal air of the storage chamber 1*a*, such as an evaporator, and a unit (not illustrated) for heating the internal air of the storage chamber 1*a*, such as an electric heater. By contrast, the machine chamber 1*b* is provided with a refrigerator (not illustrated) that forms a refrigerating cycle together with the above evaporator, and various control devices (not illustrated).

An input processing unit 10 is attached to an upper part on the left side surface of the main cabinet 1 as described above. The input processing unit 10 has a unit main body 11 having a box shape. The unit main body 11 has a solid structure. The front surface of the unit main body 11 is provided with a coin inserting port 12 and rack selection buttons 13. The left side part of the unit main body 11 can be opened and closed by a unit door that is not illustrated, and a mode selection button 14 and a cancel button 15 are provided to be exposed when the unit door is moved to be opened. The opening movement of the unit door is usually restrained by a lock mechanism that is not illustrated. The unit door becomes movable to be opened by user's operation of the lock mechanism. The inside of the unit main body 11 is provided with a money processor 16.

The coin inserting port 12 is an opening for inserting coins. The rack selection buttons 13 are a plurality of push buttons (four in the illustrated example) provided to be arranged in a vertical line. The rack selection buttons 13 are associated with respective product racks 30*a* to 30*d* that form a product storage device 20 described later. Each of the rack selection buttons 13 supplies an input signal to a controller 100 when it is pressed and operated by the user. Each of the rack selection buttons 13 includes a light source 13*a* such as an LED. The light sources 13*a* emit light in response to a lighting instruction provided from the controller 100.

The mode selection button 14 is pressed and operated by the manager to supply a replenishment signal to the controller 100. The cancel button 15 is pressed and operated by the manager to supply a cancel signal to the controller 100.

The money processor 16 performs money processing of recognizing the genuineness and the type of each of the coins inserted through the coin inserting port 12, and storing the coins for each type. The money processor 16 supplies sum information of money inserted through the coin inserting port 12 to the controller 100, and dispenses change. The change is dispensed through a coin return port 17. The money processor 16 dispenses the inserted coins through the coin return port 17 also when the user operates a return button 18 after the coins are inserted through the coin inserting port 12. The money processor 16 also dispenses the coin that could not be recognized through the coin return port 17.

Figure 3:
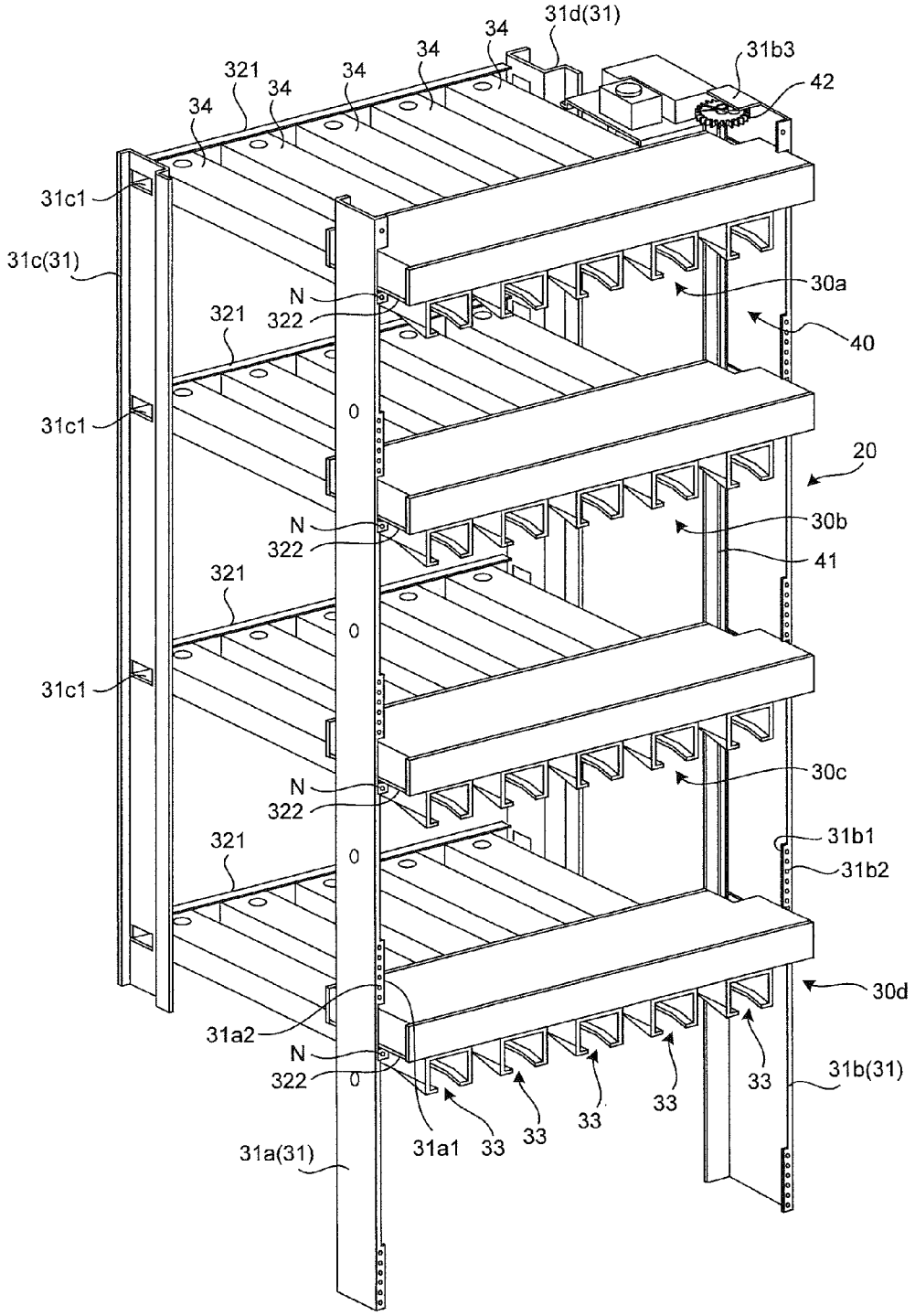
FIG. 3 is a perspective view illustrating the product storage device of the vending machine illustrated in FIG. 1, in a state where part of the components is removed.

The product storage device 20 is provided in the storage chamber 1*a* in the above main cabinet 1. FIG. 3 is a perspective view illustrating the product storage device 20 of the vending machine illustrated in FIG. 1, in a state where part of components is removed.

As also illustrated in FIG. 3, the product storage device 20 includes product racks 30*a* to 30*d* and a rack selection mechanism 40.

Figure 4:
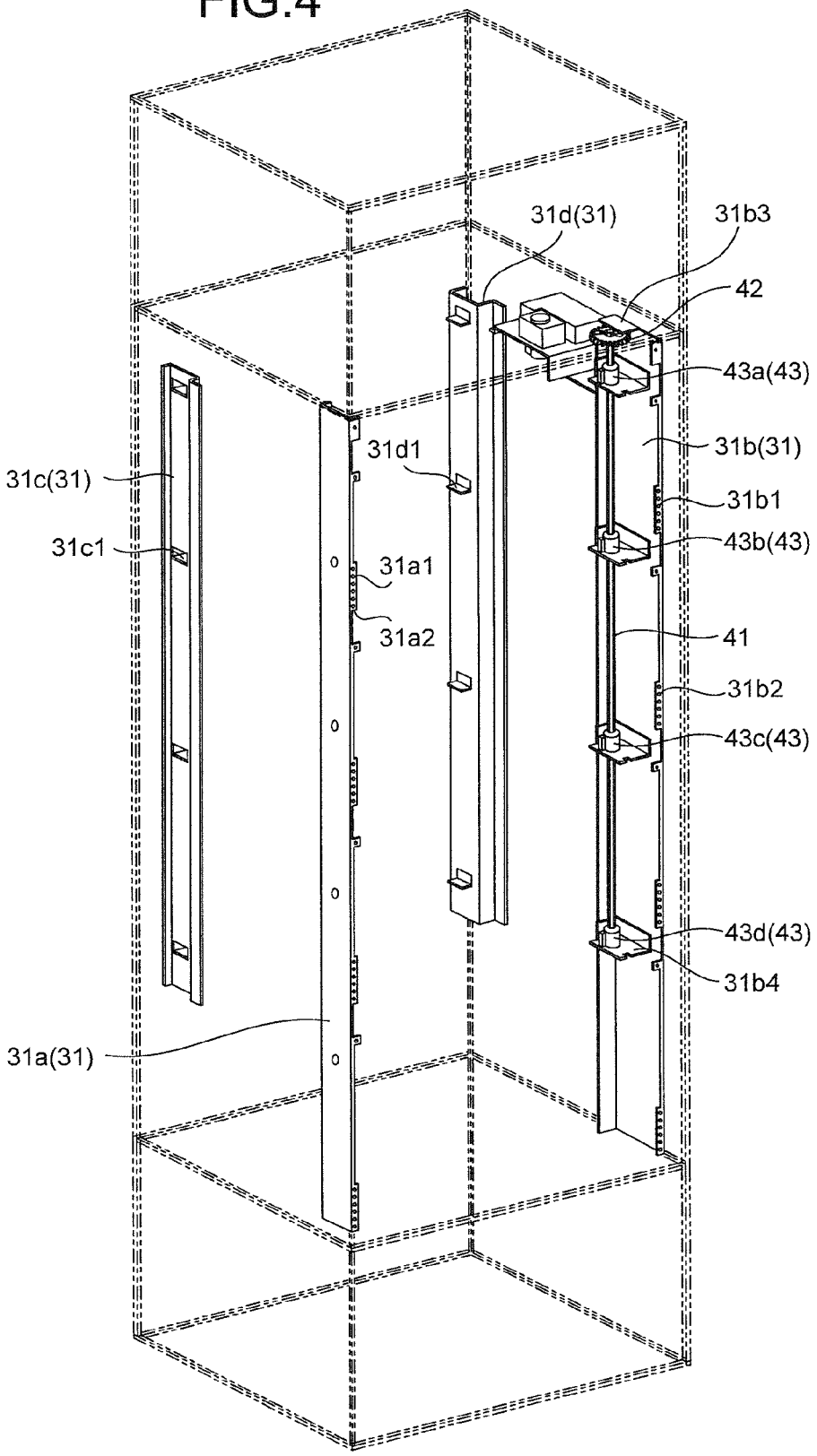
FIG. 4 is an explanatory drawing illustrating rack supporting side plates provided inside a storage chamber of a main cabinet.

The product racks 30*a* to 30*d* are a plurality of (four in the illustrated example) product racks. The product racks 30*a* to 30*d* are provided to form a plurality of stages layered along the vertical direction to extend between a pair of right and left rack support side plates 31. The rack support side plates 31 are formed by bending steel plates, and provided in a state of extending along the vertical direction in the storage chamber 1*a*, as illustrated in FIG. 4. The left front rack support side plate 31*a* and the right front rack support side plate 31*b* form a right-and-left pair, and the left rear rack support side plates 31*c* and the right rear rack support side plate 31*d* form a right-and-left pair. The left rear rack support side plate 31*c* and the right rear rack support side plate 31*d* are provided with support pieces 31*c*1 and 31*d*1, respectively, (see FIG. 4) for supporting the product racks 30*a* to 30*d* and projecting from their opposing surfaces. The left front rack support side plate 31*a* and the right front rack support side plate 31*b* are provided with a plurality of screw holes 31*a*2 and 31*b*2, respectively, through which screw members N serving as fastening members can be inserted, on their front surfaces 31*a*1 and 31*b*1, that is, surfaces facing the front opening of the main cabinet 1.

Each of the product racks 30*a* to 30*d* has a structure in which a rear horizontal member 321 serving as a rear part is engaged with the corresponding support pieces 31*c*1 and 31*d*1, and a front base member 322 serving as a front part attached to the front surfaces 31*a*1 and 31*b*1 of the left front rack support side plate 31*a* and the right front rack support side plate 31*b* with the screw members N inserted and screwed into the predetermined screw holes 31*a*2 and 31*b*2.

In the present embodiment, the product racks 30*a* to 30*d* store products being drinks in PET bottles, and have the same structure. The products being drinks in PET bottles are products in each of which drink is enclosed in a container (PET bottle) having a neck part 202 between a cap attachment part 200*a* to which a cap 200 is detachably attached and a body part 201, as illustrated in FIG. 1.

Each of the product racks 30*a* to 30*d* is formed by arranging a plurality of (five in the illustrated example) product storage columns 33 side by side along the horizontal direction. Each of the product storage columns 33 has a rail member 34. The rail member 34 extends along the front-and-rear direction and defines a product storage path 33*a*.

Figure 5:
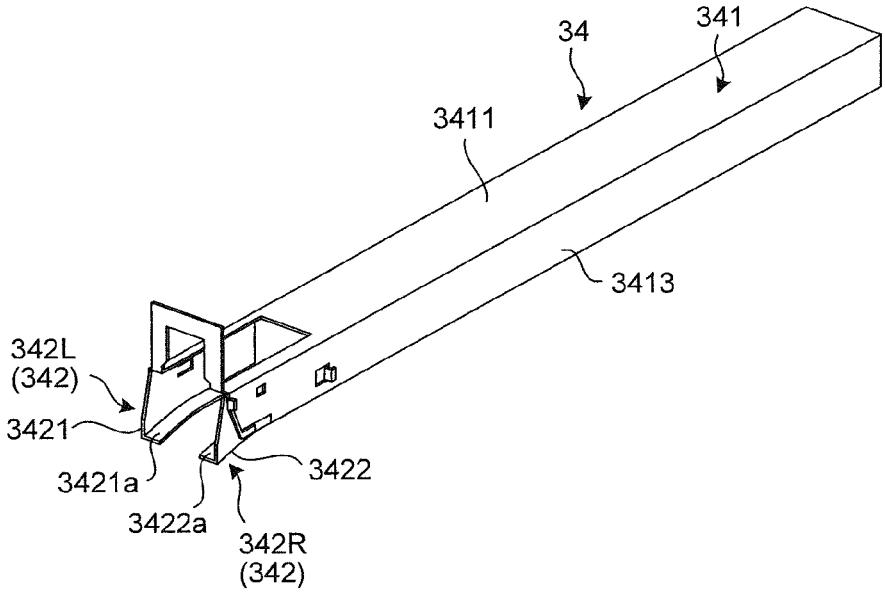
FIG. 5 is a perspective view illustrating a rail member forming the product storage column illustrated in FIG. 1 and FIG. 3.
Figure 6:
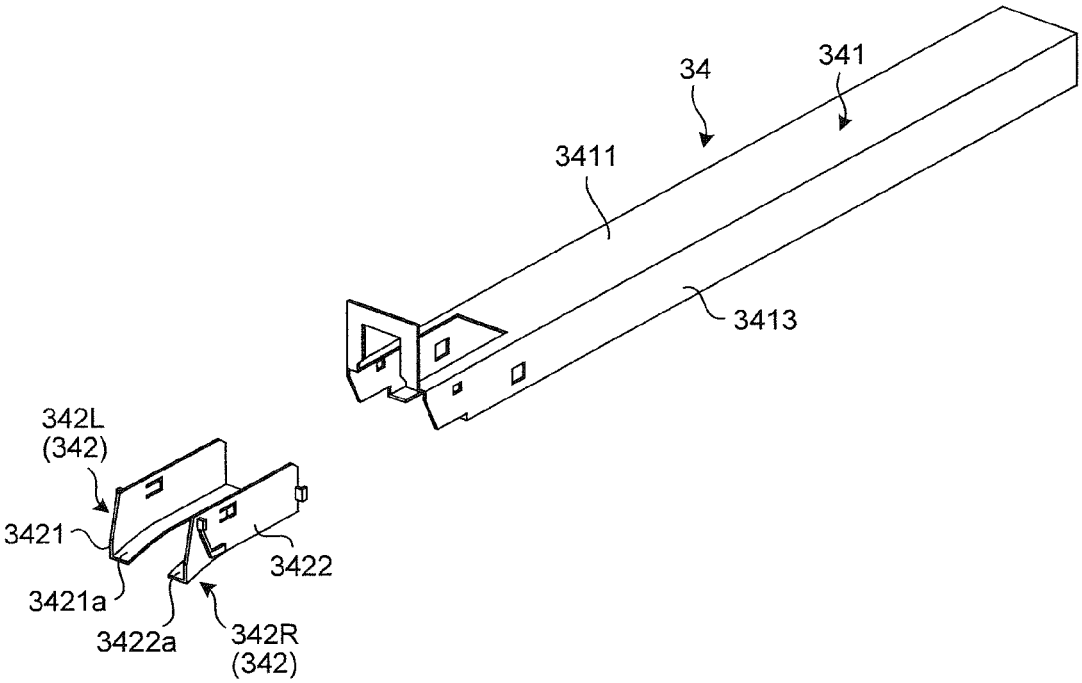
FIG. 6 is an exploded perspective view of the rail member illustrated in FIG. 5.

FIG. 5 is a perspective view illustrating the rail member 34 forming the product storage column 33 illustrated in FIG. 1 and FIG. 3, and FIG. 6 is an exploded perspective view of the rail member 34 illustrated in FIG. 5. As illustrated in FIG. 5 and FIG. 6, the rail member 34 is formed of a rail base member 341 and a front end rail part 342.

The rail base member 341 is formed by properly bending a steel plate, and has a long shape with the front-and-rear direction serving as the longitudinal direction. The rail base member 341 includes a base part 3411, a left lower extending part 3412, and a right lower extending part 3413 that are formed as one unitary piece, to have a U shape that is opened downward as viewed from front.

The base part 3411 is a horizontal part that extends along the front-and-rear direction. The base part 3411 has a rear end part supported by the rear horizontal member 321 and a front end part supported by the front base member 322. The left lower extending part 3412 extends downward from the left end part of the base part 3411, and has an extending end part that is bent rightward to form a left edge part 3412*a* (see FIG. 12), to have an L shape as viewed from front. The right lower extending part 3413 extends downward from the right end part of the base part 3411, and has an extending end part that is bent leftward to form a right edge part (not illustrated), to have an inverted L shape as viewed from front.

The left lower extending part 3412 and the right lower extending part 3413 form a left-and-right pair, and define part of the product storage path 33*a* with a space between them. The width (the minimum width between the left edge part 3412*a* and the right edge part) thereof is greater than the maximum width of the neck part 202 of the target product (drinks in PET bottles), and smaller than the maximum width of the cap attachment part 200*a* of the product.

The front end rail part 342 is formed of a resin material, and formed of a pair of a left front end rail part 342L and a right front end rail part 342R.

The left front end rail part 342L has a structure in which a front end left base part 3421 is integrated with a left front end edge part 3421*a*, to have an L shape as viewed from front. The front end left base part 3421 is a flat part extending along the vertical direction. The left front end edge part 3421*a* is formed by bending the lower end part of the front end left base part 3421 rightward.

The right front end rail part 342R has a structure in which a front end right base part 3422 is integrated with a right front end edge part 3422*a*,to have an inverted L shape as viewed from front. The front end right base part 3422 is a flat part extending along the vertical direction. The right front end edge part 3422*a* is formed by bending the lower end part of the front end right base part 3422 leftward.

The left front end rail part 342L and the right front end rail part 342R define a front end part (downstream end part) of the product storage path 33*a* with a space between them, and are gradually inclined downward toward the front.

The left front end rail part 342L and the right front end rail part 342R as described above have a size that enables entering a front end part of the rail base member 341, and are attached by entering the front end part with a predetermined part engaged, in a form where the left front end edge part 3421*a* of the left front end rail part 342L is continuous with the left edge part 3412*a* and the right front end edge part 3422*a* of the right front end rail part 342R is continuous with the right edge part.

With the left front end rail part 342L and the right front end rail part 342R attached, the rail member 34 is curved in a form where the front end part (downstream end part) is gradually inclined downward.

Figure 7:
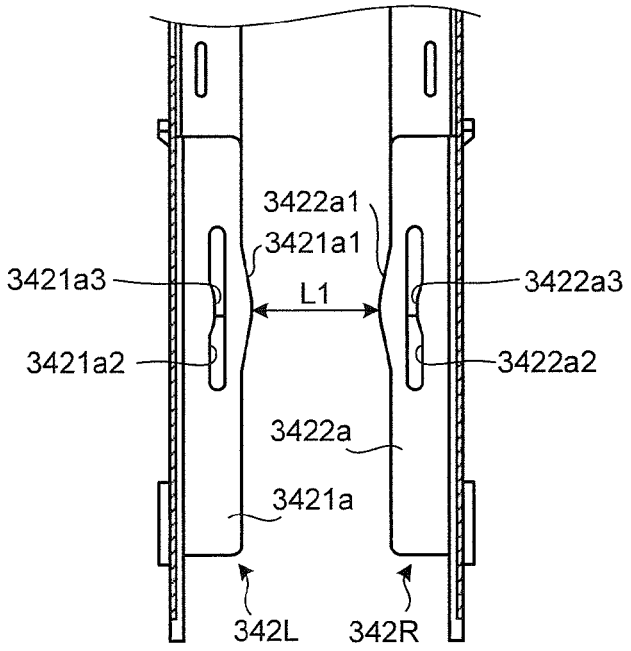
FIG. 7 is a cross-sectional plan view illustrating a structure of a front end rail part illustrated in FIG. 5 and FIG. 6, as viewed from above.
Figure 8:
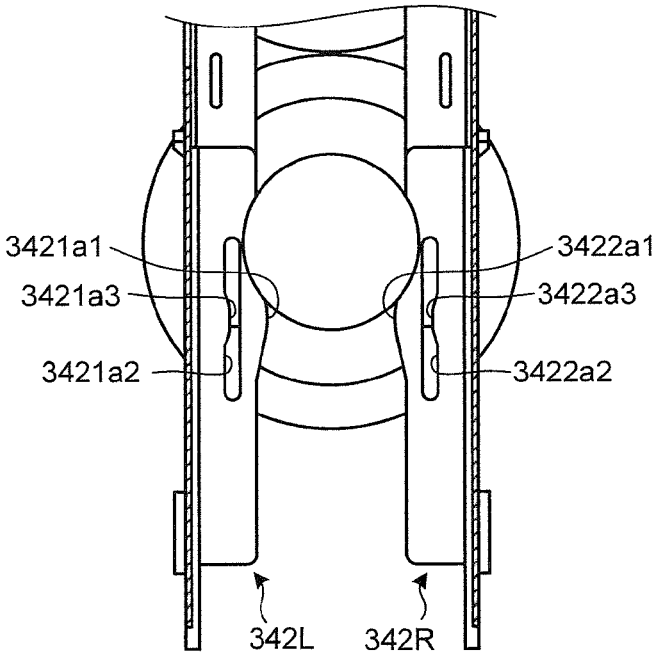
FIG. 8 is a cross-sectional plan view illustrating the structure of the front end rail part illustrated in FIG. 5 and FIG. 6, as viewed from above.

FIG. 7 and FIG. 8 are cross-sectional plan views illustrating the structure of the front end rail part 342 illustrated in FIG. 5 and FIG. 6, as viewed from above. As illustrated in FIG. 7 and FIG. 8, the left front end rail part 342L and the right front end rail part 342R are provided with raised parts 3421*a*1 and 3422*a*1, respectively, in corresponding parts thereof.

The raised part 3421*a*1 (hereinafter also referred to as left raised part 3421*a*1) of the left front end rail part 342L is formed by being raised in the substantially central region of the left front end edge part 3421*a* toward the product storage path 33*a*. In addition, the substantially central region of the left front end edge part 3421*a* is provided with a left long hole part 3421*a*2 and a left projection 3421*a*3. The left long hole part 3421*a*2 is a long hole with the front-and-rear direction serving as the longitudinal direction. The left projection 3421*a*3 is formed to project, in a part of the left long hole part 3421*a*2 opposed to the part where the left raised part 3421*a*1 is formed, toward a part where the left raised part 3421*a*1 is formed.

The raised part 3422*a*1 (hereinafter also referred to as right raised part 3422*a*1) of the right front end rail part 342R is formed by being raised, in a part located in the substantially central region of the right front end edge part 3422*a* and opposed to the left raised part 3421*a*1, toward the product storage path 33*a*. In addition, the substantially central region of the right front end edge part 3422*a* is provided with a right long hole part 3422*a*2 and a right projection 3422*a*3. The right long hole part 3422*a*2 is a long hole with the front-and-rear direction serving as the longitudinal direction. The right projection 3422*a*3 is formed to project, in a part of the right long hole part 3422*a*2 opposed to the part where the right raised part 3422*a*1 is formed, toward a part where the right raised part 3422*a*1 is formed.

In the front end rail part 342 (the left front end rail part 342L and the right front end rail part 342R) as described above, the width L1 between the left raised part 3421*a*1 and the right raised part 3422*a*1 is formed smaller than the maximum width of the neck part 202 of the target product (drinks in PET bottles). In this manner, as illustrated in FIG. 8, back-and-forth movement of the product is restrained between the left and right raised parts 3421*a*1 and 3422*a*1. When the product is pressed forward or backward by an extracting operation or a replenishment operation described later, a part of the left long hole part 3421*a*2 where the left raised part 3421*a*1 is formed in the substantially central region of the left front end edge part 3421*a* is elastically deformed until abutting on the left projection 3421*a*3, and a part of the right long hole part 3422*a*2 where the right raised part 3422*a*1 is formed in the substantially central region of the right front end edge part 3422*a* is elastically deformed until abutting on the right projection 3422*a*3, to allow movement of the product such that the width L1 between the left and right raised parts 3421*a*1 and 3422*a*1 becomes greater than the maximum width of the neck part 202.

In the above rail member 34, when the product in a standing position is inserted from the front such that the neck part 202 of the product is inserted into the product storage path 33*a*, part of the cap attachment part 200*a* of the product is placed on the left edge part 3412*a* and the right edge part of the rail base member 341, and the right front end edge part 3422*a* and the left front end edge part 3421*a* of the front end rail part 342. In this manner, the rail member 34 supports the cap attachment part 200*a* of the product to support the product in a suspended state, and store the products arranged in the front-and-rear direction in the product storage path 33*a*. In addition, the rail member 34 itself is attached in a form of being gradually inclined downward toward the front, whereby the product stored in the product storage path 33*a* is stored in a state of being movable forward by its own weight.

In this case, a forefront product (product located most downstream) in the products stored in the product storage path 33*a* is located behind the left and right raised parts 3421*a*1 and 3422*a*1 in the front end rail part 342, and restrained from moving forward by the left and right raised parts 3421*a*1 and 3422*a*1.

Figure 9:
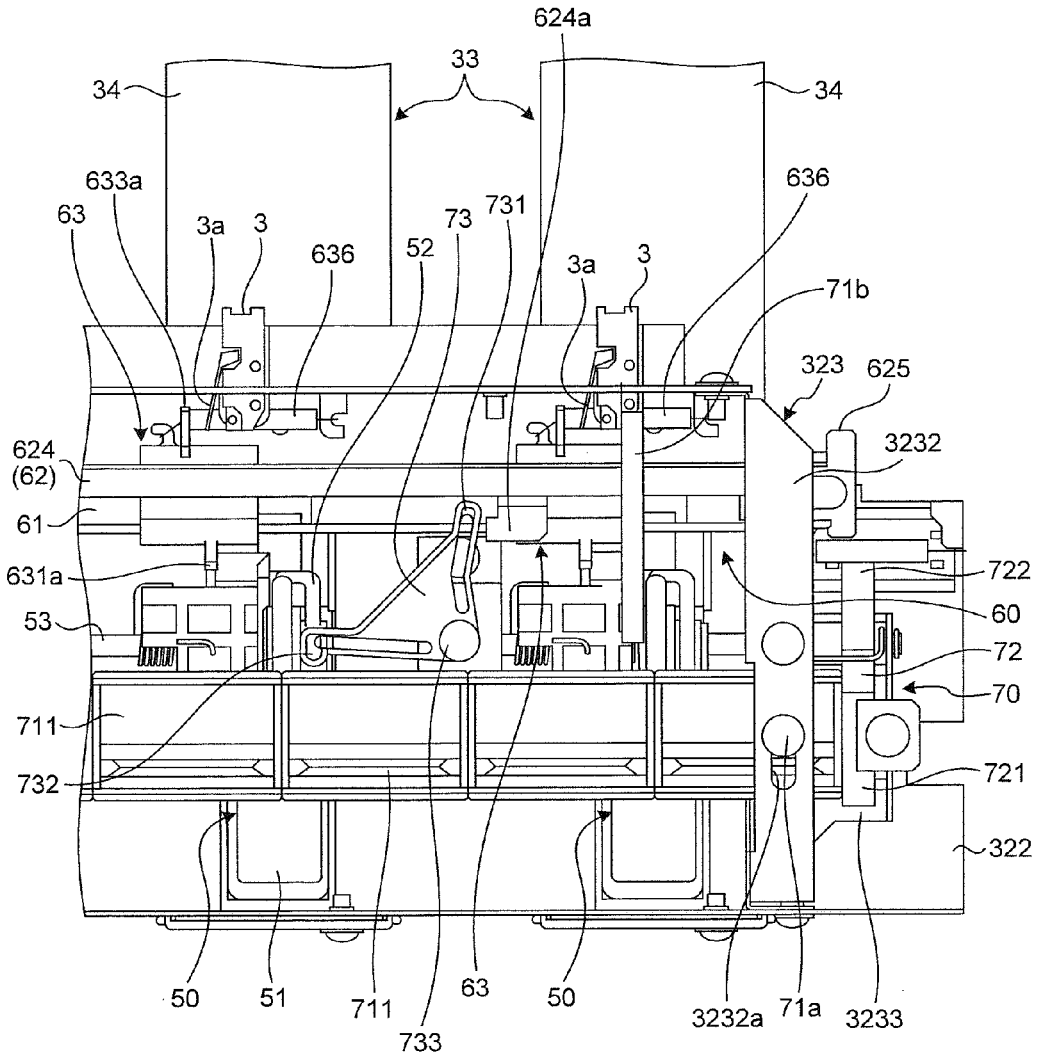
FIG. 9 is a plan view illustrating a main part of a product rack illustrated in FIG. 1 and FIG. 3.
Figure 10:
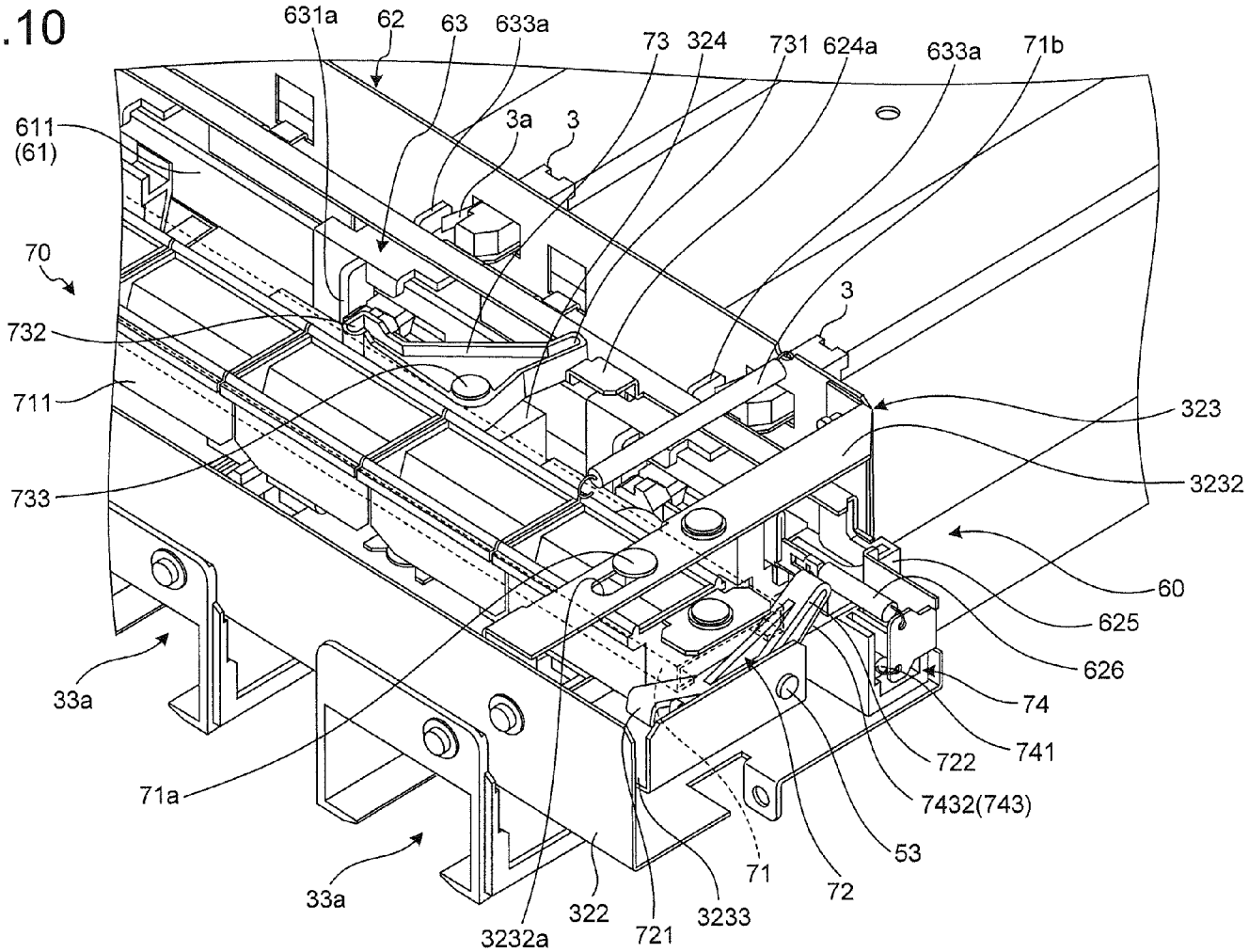
FIG. 10 is a perspective view illustrating the main part of the product rack illustrated in FIG. 9, as viewed obliquely from right front.
Figure 11:
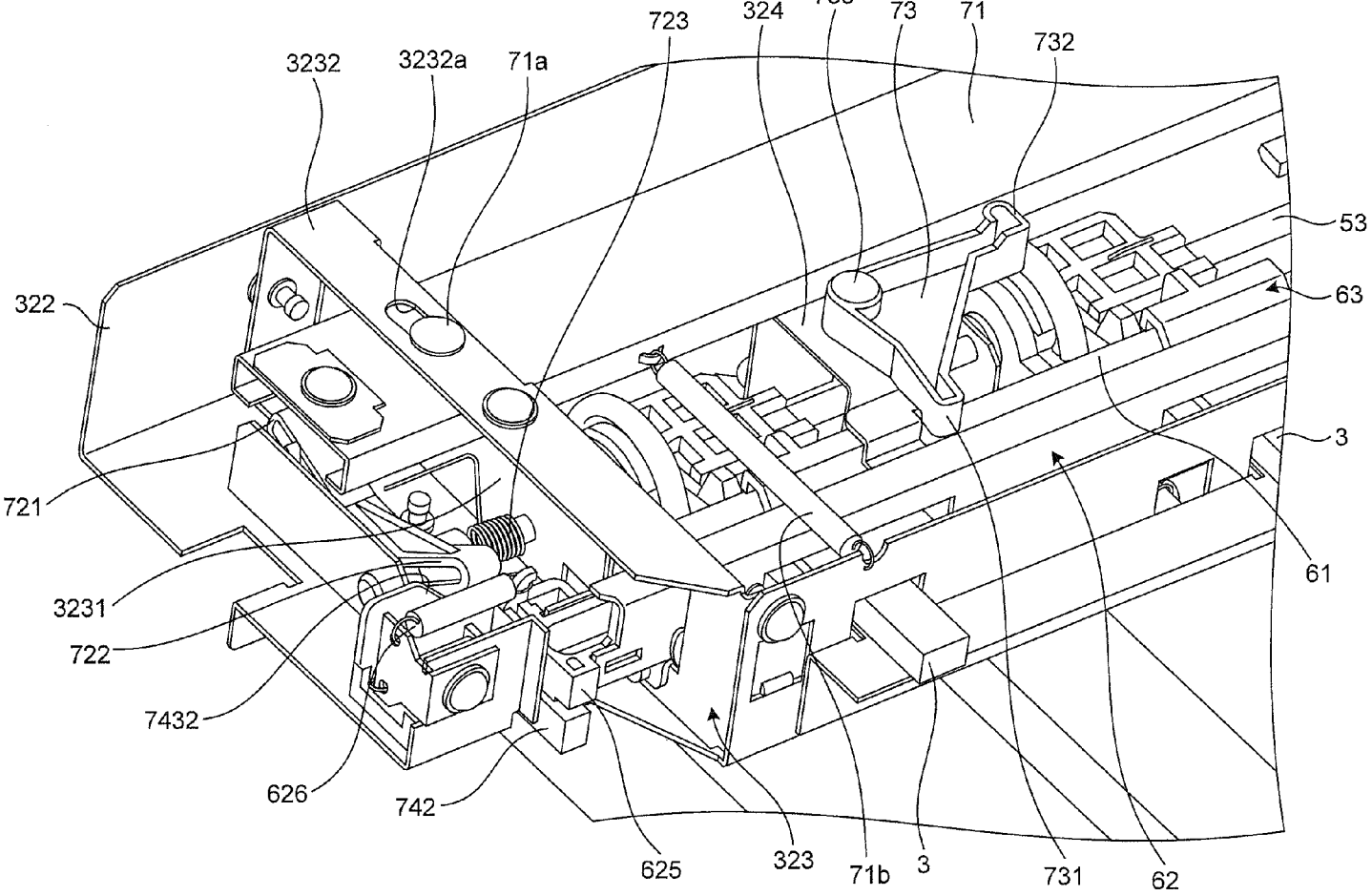
FIG. 11 is a perspective view illustrating the main part of the product rack illustrated in FIG. 9, as viewed obliquely from right behind.
Figure 12:
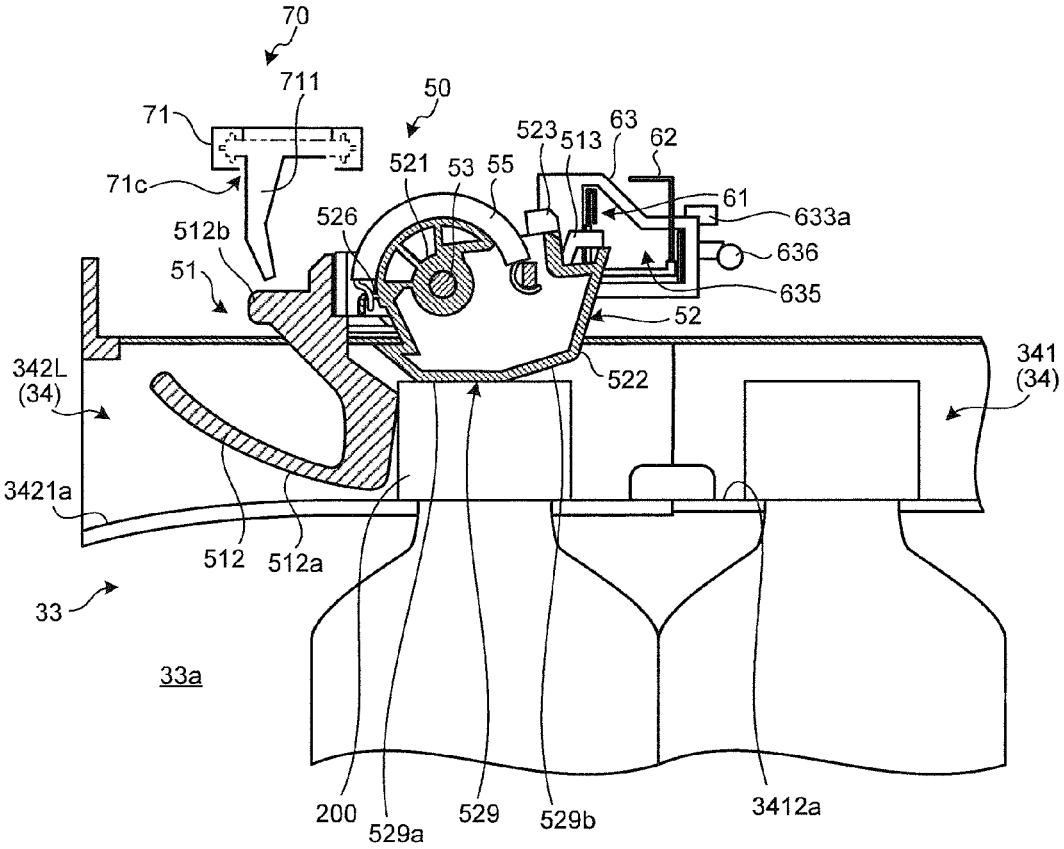
FIG. 12 is a schematic vertical cross-sectional view of the product storage column forming the product rack, as viewed from right.

FIG. 9 is a plan view illustrating a main part of the product racks 30*a* to 30*d* illustrated in FIG. 1 and FIG. 3, FIG. 10 is a perspective view of the main part of the product racks 30*a* to 30*d* illustrated in FIG. 9 as viewed obliquely from right front, and FIG. 11 is a perspective view of the main part of the product racks 30*a* to 30*d* illustrated in FIG. 9 as viewed obliquely from right behind. In FIG. 9 to FIG. 11, some constituent elements are omitted to clarify illustration. FIG. 12 is a vertical cross-sectional view schematically illustrating the product storage column 33 forming the product racks 30*a* to 30*d*, as viewed from right.

As illustrated in FIG. 9 to FIG. 11, each of the product racks 30*a* to 30*d* includes an extracting mechanism 50, a support mechanism 60, and a restraint mechanism (restraining unit) 70.

The extracting mechanism 50 is provided in each product storage column 33, and includes a main gate member 51 and a sub-gate member 52.

Figure 13:
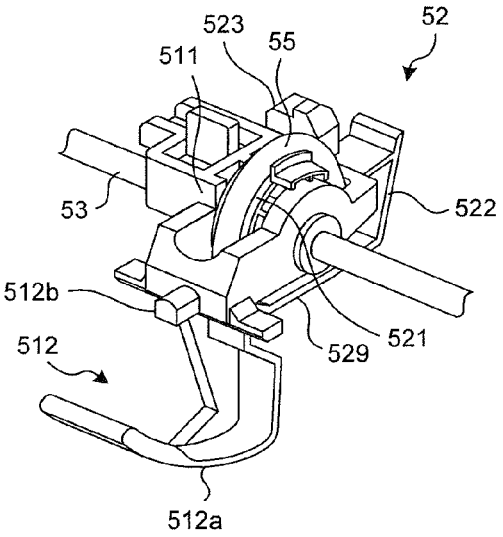
FIG. 13 is a perspective view illustrating an extracting mechanism.
Figure 14:
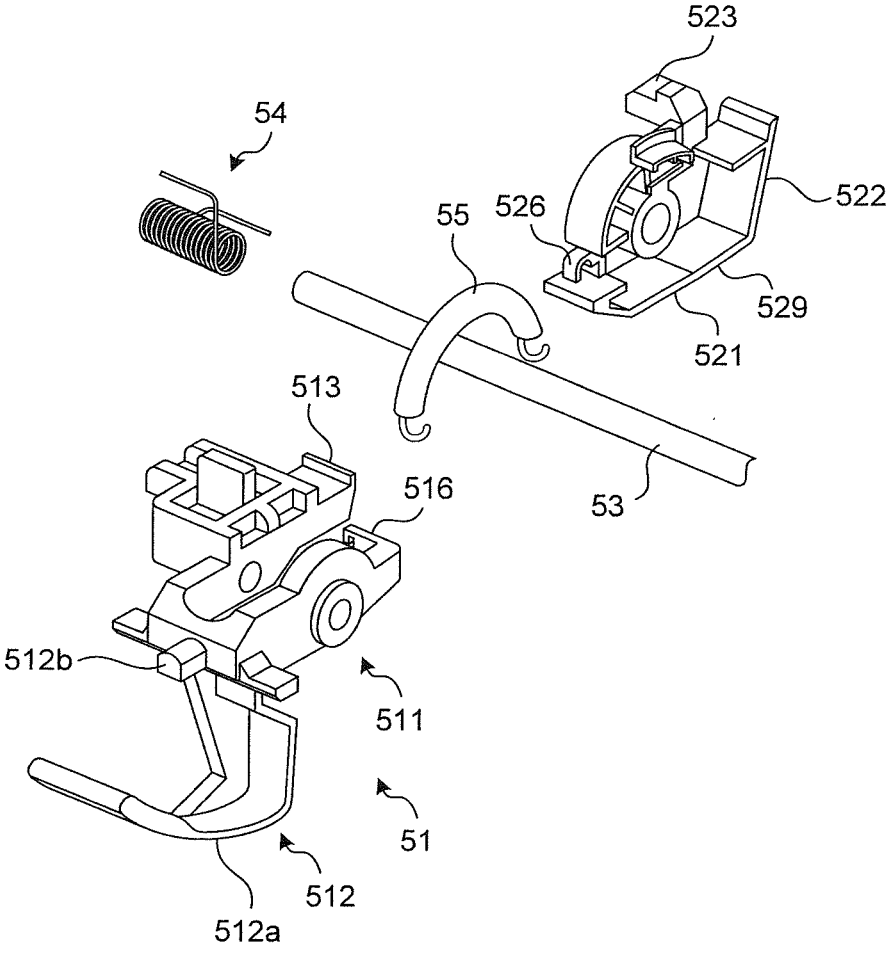
FIG. 14 is an exploded perspective view of main components of the extracting mechanism.
Figure 15:
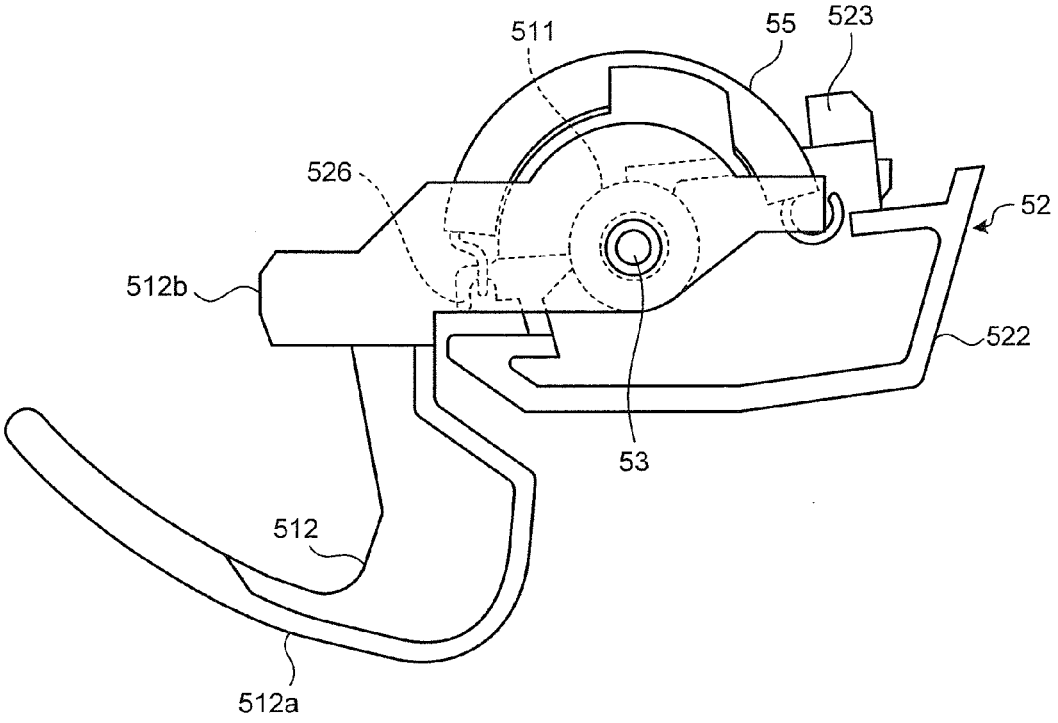
FIG. 15 is a side view of the extracting mechanism as viewed from right.
Figure 16:
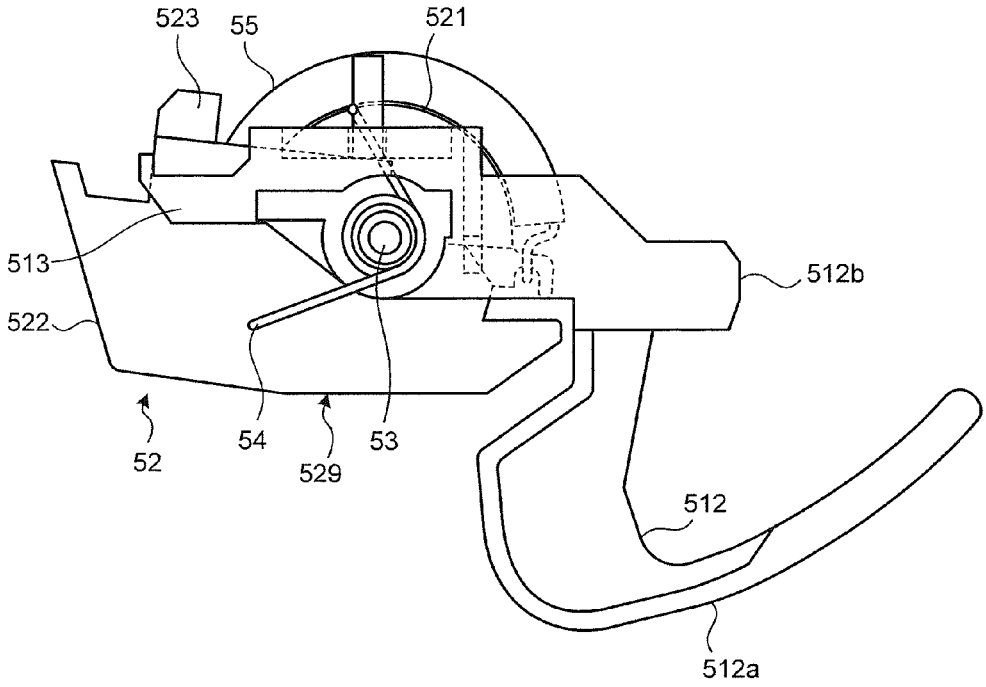
FIG. 16 is a side view of the extracting mechanism as viewed from left.

FIG. 13 is a perspective view illustrating the extracting mechanism 50, FIG. 14 is an exploded perspective view of main components of the extracting mechanism 50, FIG. 15 is a side view of the extracting mechanism 50 as viewed from right, and FIG. 16 is a side view of the extracting mechanism 50 as viewed from left. The extracting mechanism 50 will be explained hereinafter with reference to FIG. 13 to FIG. 16 as appropriate.

The main gate member 51 includes a first base end part 511 and a first distal end part 512. The first base end part 511 extends along the right-and-left direction, and is supported by a gate shaft part 53 that extends between a right support member 323 and a left support member (not illustrated) explained later in a region above the forefront product. The first distal end part 512 extends more forward than the first base end part 511, and projects downward in the middle of it. A lower part of the first distal end part 512 is provided with a sliding part 512*a* that forms a curved surface. The main gate member 51 is rotatable around the central axis of the gate shaft part 53. A gate spring member 54 is interposed between the main gate member 51 and the gate shaft part 53. With this structure, the main gate member 51 is urged by the gate spring member 54 to be rotated downward, and the first distal end part 512 goes into the product storage path 33*a*.

When the first distal end part 512 of the main gate member 51 goes into the product storage path 33*a*, the first distal end part 512 is located in a region in front of the forefront product. When the main gate member 51 is rotated upward against the urging force of the gate spring member 54, the first distal end part 512 is retreated from the product storage path 33*a*. The main gate member 51 also includes a first engaging piece 513 that projects backward.

The sub-gate member 52 is provided behind the main gate member 51, and includes a second base end part 521 and a second distal end part 522. The second base end part 521 enters the first base end part 511 and is supported by the gate shaft part 53. The second distal end part 522 extends more backward than the second base end part 521, and has a lower end part projecting more downward than the second base end part 521. The sub-gate member 52 is rotatable around the central axis of the gate shaft part 53. Specifically, the sub-gate member 52 is disposed to be rotatable around the central axis of the shaft part shared with the main gate member 51.

The sub-gate member 52 as described above is coupled with the main gate member 51 via a coil spring member 55. More specifically, the coil spring member 55 is hooked between a hook groove 516 of the main gate member 51 and a hook groove 526 of the sub-gate member 52, to define the mutual positional relation between the main gate member 51 and the sub-gate member 52 by being urged by the coil spring member 55.

In this manner, the sub-gate member 52 is in a position where the second distal end part 522 thereof is retreated from the product storage path 33*a* when the first distal end part 512 of the main gate member 51 enters the product storage path 33*a*. By contrast, when the first distal end part 512 of the main gate member 51 is retreated from the product storage path 33*a*, the second distal end part 522 enters the product storage path 33*a*. When the second distal end part 522 enters the product storage path 33*a* as described above, the second distal end part 522 is located in a region in front of a second product from the forefront (a second product).

The sub-gate member 52 also includes a second engaging piece 523 that projects leftward. The second engaging piece 523 goes into and is engaged with a front recess of the first engaging piece 513 in the main gate member 51.

The sub-gate member 52 also includes a pressing part 529. The pressing part 529 is provided to couple a lower end part of the sub-gate member 52, that is, the lower end part of the second base end part 521 with the lower end part of the second distal end part 522. In the pressing part 529 as described above, a first pressing surface 529*a* located in the front is formed to be continuous with a second pressing surface 529*b* located in the rear. As illustrated in FIG. 12, even when the sub-gate member 52 is retreated from the product storage path 33*a*, the first pressing surface 529*a* abuts on the cap 200 of the forefront product.

Because the sub-gate member 52 as described above is coupled with the main gate member 51 via the coil spring member 55, the sub-gate member is basically rotated together with the main gate member 51. However, the sub-gate member 52 is rotated upward against the urging force of the coil spring member 55, when any force that retreats the second distal end part 522 from the product storage path 33*a* acts on the second distal end part 522.

Figure 17:
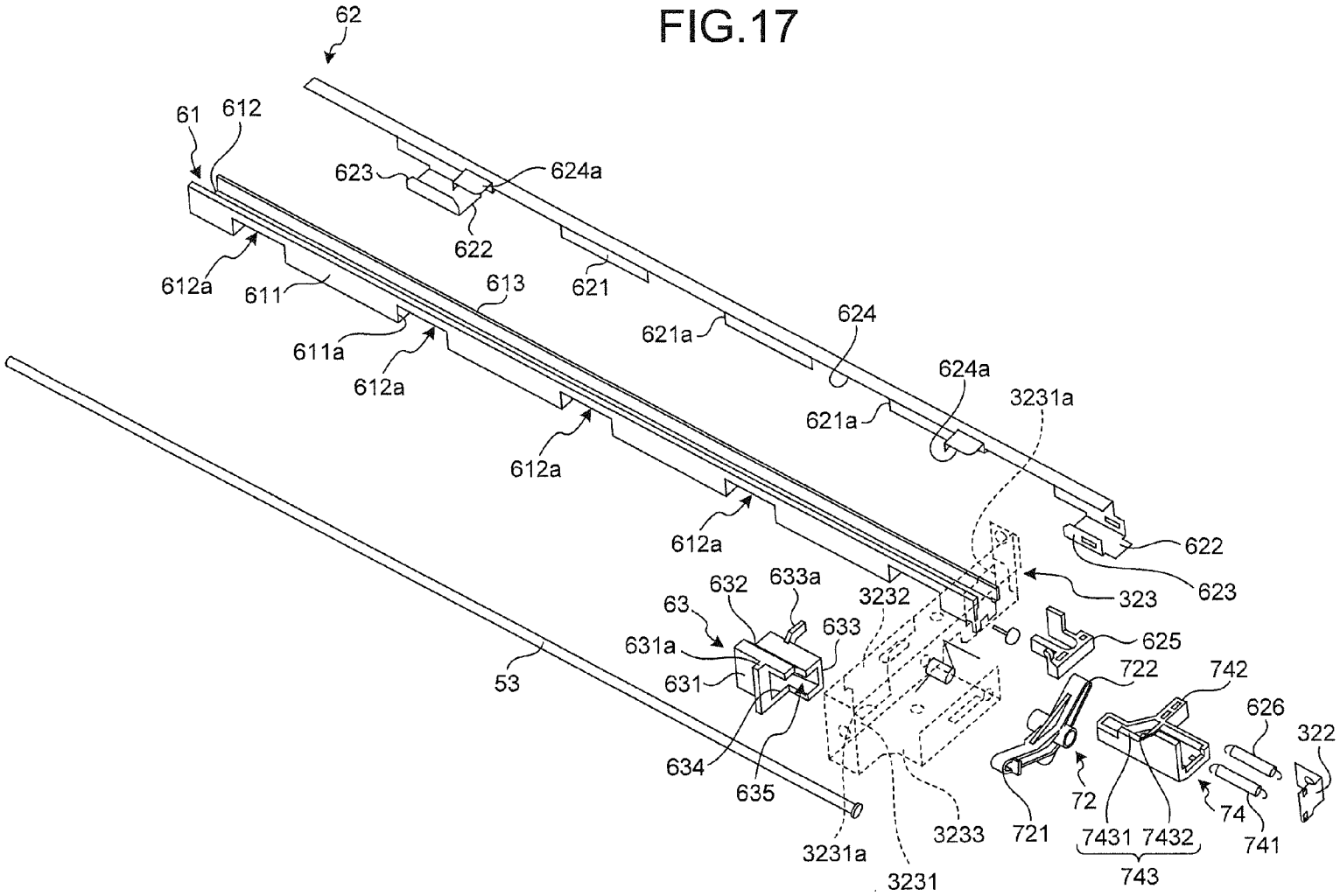
FIG. 17 is an exploded perspective view of part of components of the product rack illustrated in FIG. 9 to FIG. 11.

FIG. 17 is an exploded perspective view of part of constituent elements of the product racks 30*a* to 30*d* illustrated in FIG. 9 to FIG. 11. Explanation will be made hereinafter with reference to FIG. 17 as appropriate.

The support mechanism 60 includes a fixed plate 61, a slide plate 62, and a lock member 63. The fixed plate 61 is provided to extend along the right-and-left direction in a front region above the product storage columns 33 in each of the product racks 30*a* to 30*d*. The fixed plate 61 is fixed by being supported at a right end part by the right support member 323 and supported at a left end part by a left support member that is not illustrated.

The right support member 323 is formed by bending and machining a steel plate, and has a longitudinal direction being the front-and-rear direction. The right support member 323 is fixed at the right end part of the front base member 322, and includes a right support base part 3231 extending in the vertical direction, an upper horizontal part 3232 extending from the upper edge part of the right support base part 3231 toward the horizontal direction, and a lower right extending part 3233 extending rightward from the lower edge part of the right support base part 3231. The right support base part 3231 is provided with a plurality of through holes 3231*a*.

The left support member is formed by bending and machining a steel plate in the same manner as the right support member 323, and has a longitudinal direction being the front-and-rear direction. The left support member is fixed at the left end part of the front base member 322, to form a right-and-left pair with the right support member 323.

In this manner, the right end part of the fixed plate 61 is fixed by screw members or the like in a state of extending through the through holes 3231*a* of the right support base part 3231 in the right support member 323, and the left end part of the fixed plate 61 is fixed by screw members or the like in a state of extending through the through holes in the left support member.

The fixed plate 61 as described above includes a fixing base part 611 extending along the vertical direction, a fixing bottom part 612 extending and bent backward from the lower end of the fixing base part 611, and a fixing upper extending part 613 extending and bent upward from the rear end of the fixing bottom part 612.

The fixing bottom part 612 is provided with a plurality of cutoff parts 612*a* communicating with cutoff parts 611*a* formed in the fixing base part 611. The number of the cutoff parts 612*a* formed in the fixing bottom part 612 is five that is equal to the number of the product storage columns forming each of the product racks 30*a* to 30*d*.

The slide plate 62 is provided to extend along the right-and-left direction in a front region above the product storage columns in each of the product racks 30*a* to 30*d*. The slide plate 62 includes a slide base part 621 extending along the vertical direction, a slide bottom part 622 extending from a lower end of a predetermined part of the slide base part 621 and bent forward, a slide upper extending part 623 extending from the front end of the slide bottom part 622 and bent upward, and a slide front extending part 624 extending from the upper end of the slide base part 621 and bent forward.

The slide plate 62 as described above is provided in parallel with the fixed plate 61 behind the fixing base part 611 of the fixed plate 61. Specifically, the slide plate 62 is provided such that the slide bottom part 622 thereof is placed in a region above the fixing bottom part 612 between the fixing base part 611 and the fixing upper extending part 613, and the right end part of the slide plate 62 extends through the through hole 3231*a* of the right support member 323. In addition, the slide base part 621 in the slide plate 62 is provided with a plurality of (for example, five) inserting parts 621*a* corresponding to the number of the cutoff parts 612*a*.

In addition, the slide front extending part 624 of the slide plate 62 is provided with a plurality of (two in FIG. 17) slide action pieces 624*a*. The slide action pieces 624*a* are provided to project forward from the slide front extending part 624.

The slide plate 62 is provided at right end with a slide abutting part 625. The slide abutting part 625 is coupled with the front base member 322 via a slide spring member 626. In this manner, the slide plate 62 is always urged rightward by the slide spring member 626, and located in a standard position in the normal state.

The lock member 63 is formed of, for example, a resin material, and has a structure in which a front end part 631, an upper part 632, a rear end part 633, and a lower part 634 are continuously formed to have a hollow part 635. The front end part 631 of the lock member 63 is provided with a projecting piece 631*a* that projects forward. The lock member 63 as described above is provided by inserting the fixed plate 61 through the hollow part 635 thereof in the form in which the upper part 632 is inserted into the inserting part 621*a* of the slide plate 62, as illustrated in FIG. 9 to FIG. 12. Specifically, the front end part 631 of the lock member 63 is located in front of the fixing base part 611 of the fixed plate 61, the rear end part 633 of the lock member 63 is located behind the fixing upper extending part 613 of the fixed plate 61, and the lower part 634 of the lock member 63 is located under the fixing bottom part 612 of the fixed plate 61. The rear end part 633 of the lock member 63 is provided with a lock action piece 633*a* that projects backward.

The rear end part 633 of the lock member 63 as described above is coupled with the front base member 322 via a lock spring member 636, and the lock member 63 is urged rightward by the lock spring member 636.

An extraction detection switch 3 is provided in a region behind the lock member 63. The extraction detection switch 3 is attached to the rear end part 633 of the front base member 322, and each switch is provided to correspond to the product storage column 33. The extraction detection switch 3 is turned off in a normal state. When the lock member 63 is urged by the lock spring member 636 and moved rightward, the extraction detection switch 3 is turned on by pressing the lock action piece 633*a* of the lock member 63 on a contact 3*a* of the extraction detection switch 3, and supplies a turn-on signal to the controller 100.

The restraint mechanism 70 includes a guide member 71, a first link member (adjusting member) 72, a second link member 73, and a link slide member 74.

The guide member 71 is provided to extend along the right-and-left direction in a front upper region of each product storage column 33 in each of the product racks 30*a* to 30*d*. More specifically, the guide member 71 includes a right end part extending through the through hole 3231*a* of the right support member 323, a left end part that is not illustrated and extending through the through hole of the left support member, and a stepped screw 71*a* attached thereto inserted through long holes 3232*a* provided in the upper horizontal parts 3232 of the right support member 323 and the left support member. In this manner, the guide member 71 is provided to be movable along the front-and-rear direction. The guide member 71 is urged backward by a guide spring member 71*b* coupling it with the front base member 322, and moved backward to be located in a standard position in the normal state. When the guide member 71 is located in a standard position as described above, a housing region 71*c* opened below the guide member 71 is located on a rotation locus of a projection (enterable region) 512*b* of the main gate member 51.

The housing region 71*c* is provided with a plurality of piece members 711, as illustrated in (a) of FIG. 18. These piece members 711 are housed in the housing region 71*c* of the guide member 71 such that they are slidable along the right-and-left direction. The total width of spaces S1 and S2 formed in the housing region 71*c* in the guide member 71 is slightly greater than the width of each projection 512*b* of the main gate member 51 forming the extracting mechanism 50.

As illustrated in FIG. 9 to FIG. 11, the first link member 72 is provided to be rotatable around the central axis of the gate shaft part 53 in a region above the lower right extending part 3233 of the right support member 323. The first link member 72 includes a front part 721 located in front of the inserting part through which the gate shaft part 53 is inserted, and a rear part 722 located behind the inserting part, to have a substantially V shape.

In the first link member 72 as described above, the front part 721 is urged to be rotated upward by a first link spring member 723. In this manner, when the guide member 71 is located in the standard position, the front part 721 enters the housing region 71*c* of the guide member 71. When the front part 721 of the first link member 72 enters the housing region 71*c* of the guide member 71 as described above, the total width of the spaces S1 and S2 of the housing region 71*c* is set smaller than the width of each projection 512*b* of the main gate member 51, as illustrated in (b) of FIG. 18. In this manner, when the front part 721 of the first link member 72 enters the housing region 71*c*, none of the main gate members 51 can enter the housing region 71*c*.

When the guide member 71 is moved forward against the urging force of the guide spring member 71*b*, the first link member 72 is pressed by the rear end part of the guide member 71. In this manner, the front part 721 in the first link member 72 is rotated downward against the urging force of the first link spring member 723, and the front part 721 is withdrawn from the housing region 71*c*.

As illustrated in FIG. 9 to FIG. 11, the second link member 73 is provided on a second link support plate 324 fixed on the front base member 322, such that the second link member 73 is rotatable around the central axis of a link shaft part 733. The second link member 73 is branched to fork from the link shaft part 733 toward the outside of the diameter, a first link end part 731 abuts on the slide action piece 624*a* of the slide plate 62, and a second link end part 732 abuts on the guide member 71.

When the slide plate 62 is slid leftward from the standard position, the second link member 73 having the above structure is rotated around the central axis of the link shaft part 733, and the second link end part 732 moves the guide member 71 forward against the urging force of the guide spring member 71*b*.

The link slide member 74 is coupled with the front base member 322 via a link slide spring member 741 to extend through the through hole 3231*a* of the right support member 323 in a region behind the first link member 72. In the normal state, the link slide member 74 is urged by the link slide spring member 741 to move rightward and be located in the standard position. When the link slide member 74 is located in the standard position as described above, a link slide abutting part 742 is positioned in a region under the slide abutting part 625 of the slide plate 62 located in the standard position.

A front end upper extending part 743 of the link slide member 74 abuts on the rear part 722 of the first link member 72. The front end upper extending part 743 of the link slide member 74 as described above has a structure in which a horizontal abutting part 7431 and an inclined abutting part 7432 are continuously formed, as illustrated in FIG. 17. The inclined abutting part 7432 is a part that is gradually inclined upward toward the right.

The link slide member 74 as described above in the standard position abuts at the horizontal abutting part 7431 on the first link member 72, to allow the front part 721 of the first link member 72 to be rotated upward. By contrast, when the link slide member 74 is moved leftward from the standard position, the link slide member 74 abuts at the inclined abutting part 7432 on the first link member 72, to rotate the front part 721 of the first link member 72 downward against the urging force of the first link spring member 723.

Next, the rack selection mechanism 40 will be explained hereinafter. The rack selection mechanism 40 includes a support rod 41. The support rod 41 is a bar member having, for example, a hexagonal prism shape, and provided on the front right rack support side plate 31*b* to be rotatable around the central axis thereof, as illustrated in FIG. 4. More specifically, the upper end part of the support rod 41 is supported by an upper end piece 31*b*3 of the right front rack support side plate 31*b*, and the lower end part of the support rod 41 is supported by a cam base member 31*b*4 provided to correspond to the height level of the lowermost product rack 30*d*, such that the support rod 41 is rotatable around the central axis thereof.

The upper end part of the support rod 41 is provided with a coupling gear 42. The coupling gear 42 is engaged with an output gear (not illustrated) of a motor M via a linkage gear that is not illustrated. The motor M is a driving source that is driven by a drive instruction provided from the controller 100 (see FIG. 2), to drive the output gear clockwise when the output gear is viewed from above. In this manner, the coupling gear 42 engaged with the output gear via the linkage gear is also rotated clockwise as viewed from above, and the support rod 41 is also rotated clockwise around the central axis thereof.

A plurality (for example, four) of switching cam members 43 are attached to the support rod 41 as described above. The switching cam members 43 are attached such that the support rod 41 extends through their hexagonal through holes 431, and correspond to the respective height levels of the respective product racks 30*a* to 30*d*. Each of the switching cam members 43 rotates together with the support rod 41. Each of the switching cam members 43 is movable along the extending direction (vertical direction) of the support rod 41 in the state where the support rod 41 extending through it, to move its position in accordance with the height level of each of the product racks 30*a* to 30*d*. Specifically, the switching cam members 43 can follow the height levels of the product racks 30*a* to 30*d*.

Figure 19:
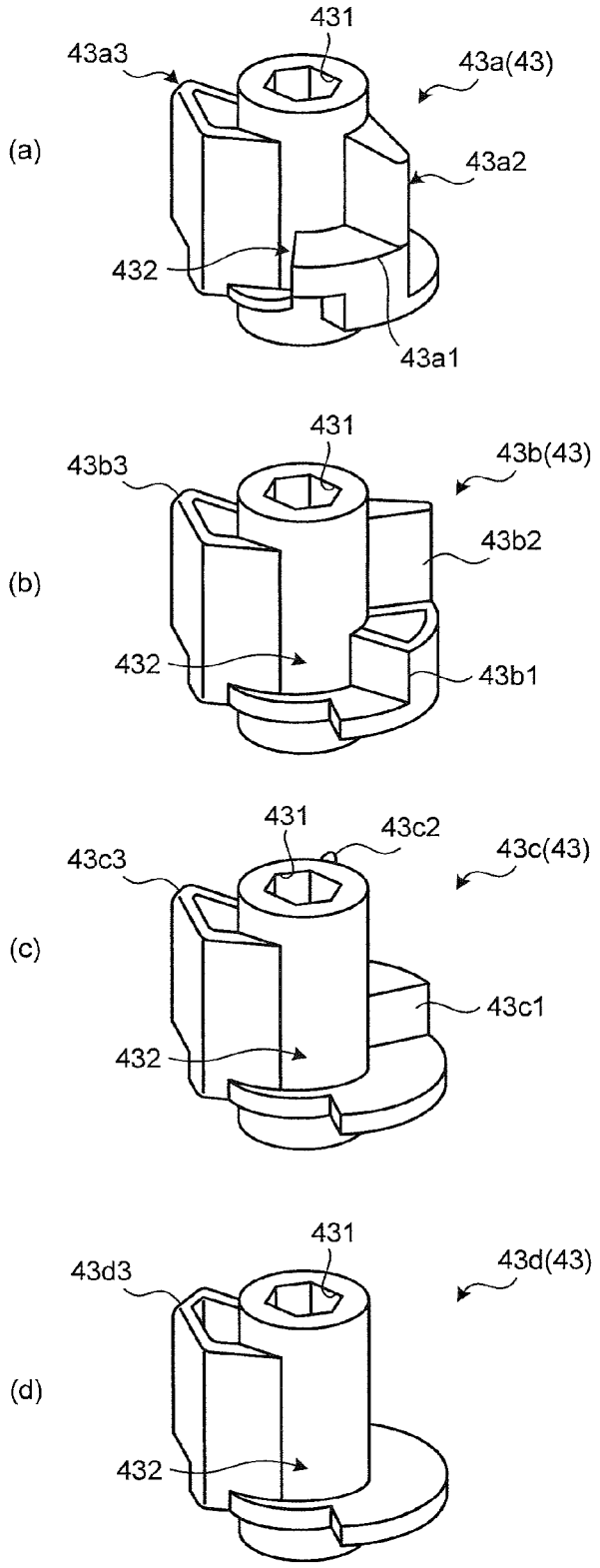
FIGS. 19(*a*) to 19(*d*) are perspective views illustrating switching cam members forming a rack selection mechanism, (a) illustrating a switching cam member corresponding to the uppermost product rack, (b) illustrating a switching cam member corresponding to the second product rack from the uppermost rack, (c) illustrating a switching cam member corresponding to the third product rack from the uppermost rack, and (d) illustrating a switching cam member corresponding to the lowermost product rack.

FIG. 19 is a perspective view illustrating the switching cam members 43 attached to the support rod 41 illustrated in FIG. 4, (a) illustrating the switching cam member 43 (hereinafter also referred to as a first switching cam member 43*a*) corresponding to the uppermost product rack 30*a*, (b) illustrating the switching cam member 43 (hereinafter also referred to as a second switching cam member 43*b*) corresponding to the second product rack 30*b* from the uppermost rack, (c) illustrating the switching cam member 43 (hereinafter also referred to as a third switching cam member 43*c*) corresponding to the third product rack 30*c* from the uppermost rack, and (d) illustrating the switching cam member 43 (hereinafter also referred to as a fourth switching cam member 43*d*) corresponding to the lowermost product rack 30*d*.

As illustrated in FIG. 19, the switching cam members 43 are provided with respective standby part 432 serving as the standard position, first projecting pieces 43*a*1, 43*b*1, 43*c*1, and 43*d*1, second projecting pieces 43*a*2, 43*b*2, and 43*c*2, and third projecting pieces 43*a*3, 43*b*3, 43*c*3, and 43*d*3, respectively. The first projecting pieces 43*a*1, 43*b*1, 43*c*1, and 43*d*1 are provided to project in a lower part of an external circumferential surface of the switching cam members 43 toward the outside of diameter, to form selling parts. The first projecting pieces 43*a*1, 43*b*1, 43*c*1, and 43*d*1 are formed over, for example, 60° clockwise about the central axis of the switching cam members 43 (central axis of the support rod 41). The second projecting pieces 43*a*2, 43*b*2, and 43*c*2 are formed to extend more upward than the respective end parts of the first projecting pieces 43*a*1, 43*b*1, and 43*c*1. The third projecting pieces 43*a*3, 43*b*3, and 43*c*3 of the switching cam members 43 excluding the fourth switching cam member 43*d* are provided in portions distant from the respective second projecting pieces 43*a*2, 43*b*2, and 43*c*2 by a predetermined angle counterclockwise about the central axis (central axis of the support rod 41), and extend along the vertical direction. The third projecting piece 43*d*3 of the fourth switching cam member 43*d* is formed to extend more upward than the end part of the first projecting piece 43*d*1. Specifically, the fourth switching cam member 43*d* is not provided with the second projecting piece, because the third projecting piece 43*d*3 having the above shape also serves as the second projecting piece.

In the switching cam members 43 attached to the support rod 41, the first projecting pieces 43*a*1, 43*b*1, 43*c*1, and 43*d*1 are provided to be distant from each other by a predetermined angle around the central axis of the support rod 41, and the standby parts 432 and the third projecting pieces are provided to vertically match with each other.

The following describes an example of placement of the first projecting pieces 43*a*1, 43*b*1, 43*c*1, and 43*d*1 and the third projecting pieces 43*a*3, 43*b*3, 43*c*3, and 43*d*3 in the switching cam members 43. The example explained hereinafter is a mere example, and the present invention is not limited to it as a matter of course.

In the second switching cam member 43*b*, the first projecting piece 43*b*1 is provided to be dislocated from the first projecting piece 43*a*1 and the second projecting piece 43*a*2 of the first switching cam member 43*a* by 60° counterclockwise about the central axis of the support rod 41.

In the third switching cam member 43*c*, the first projecting piece 43*c*1 is provided to be dislocated from the first projecting piece 43*b*1 of the second switching cam member 43*b* by 60° counterclockwise about the central axis of the support rod 41.

In the fourth switching cam member 43*d*, the first projecting piece 43*d*1 is provided to be dislocated from the first projecting piece 43*c*1 of the third switching cam member 43*c* by 60° counterclockwise about the central axis of the support rod 41.

The third projecting piece 43*a*3 in the first switching cam member 43*a* is provided to be dislocated from the first projecting piece 43*a*1 in the first switching cam member 43*a* by 240° counterclockwise about the central axis of the support rod 41. The third projecting piece 43*b*3 in the second switching cam member 43*b* is provided to be dislocated from the first projecting piece 43*b*1 in the second switching cam member 43*b* by 180° counterclockwise about the central axis of the support rod 41. The third projecting piece 43*c*3 in the third switching cam member 43*c* is provided to be dislocated from the first projecting piece 43*c*1 in the third switching cam member 43*c* by 120° counterclockwise about the central axis of the support rod 41. The third projecting piece 43*d*3 in the fourth switching cam member 43*d* is provided to be dislocated from the first projecting piece 43*d*1 in the fourth switching cam member 43*d* by 60° counterclockwise about the central axis of the support rod 41.

The standby parts 432 of the switching cam members 43 correspond to a side surface of the support rod 41 serving as a bar-shaped member having a hexagonal prism shape, and the third projecting pieces 43*a*3, 43*b*3, 43*c*3, and 43*d*3 of the switching cam members 43 correspond to another side surface of the support rod 41. The first projecting pieces 43*a*1, 43*b*1, 43*c*1, and 43*d*1 correspond to the other respective side surfaces of the support rod 41.

In this manner, their positions are made correspond to the respective side surfaces of the support rod 41, whereby the positions can be evenly arranged by 60° when the support rod 41 is rotated by 360°.

A mode detection switch 4 (see FIG. 2) detects the rotational angle positions of the above switching cam members 43. The mode detection switch 4 detects the rotational angle positions of the switching cam members 43 by detecting the state of a mode gear (not illustrated) that is engaged with the output gear of the motor M. When the mode detection switch 4 detects the rotational angle positions, the mode detection switch 4 supplies them as a detection signal to the controller 100. The following describes an example of the rotational angle positions detected by the mode detection switch 4. The example explained herein is a mere example, and the present invention is not limited to it as a matter of course.

The rotational angle positions detected by the mode detection switch 4 are six positions, that is, "standby position", "60° rotated position", "120° rotated position", "180° rotated position", "240° rotated position", and "300° rotated position".

Figure 20:
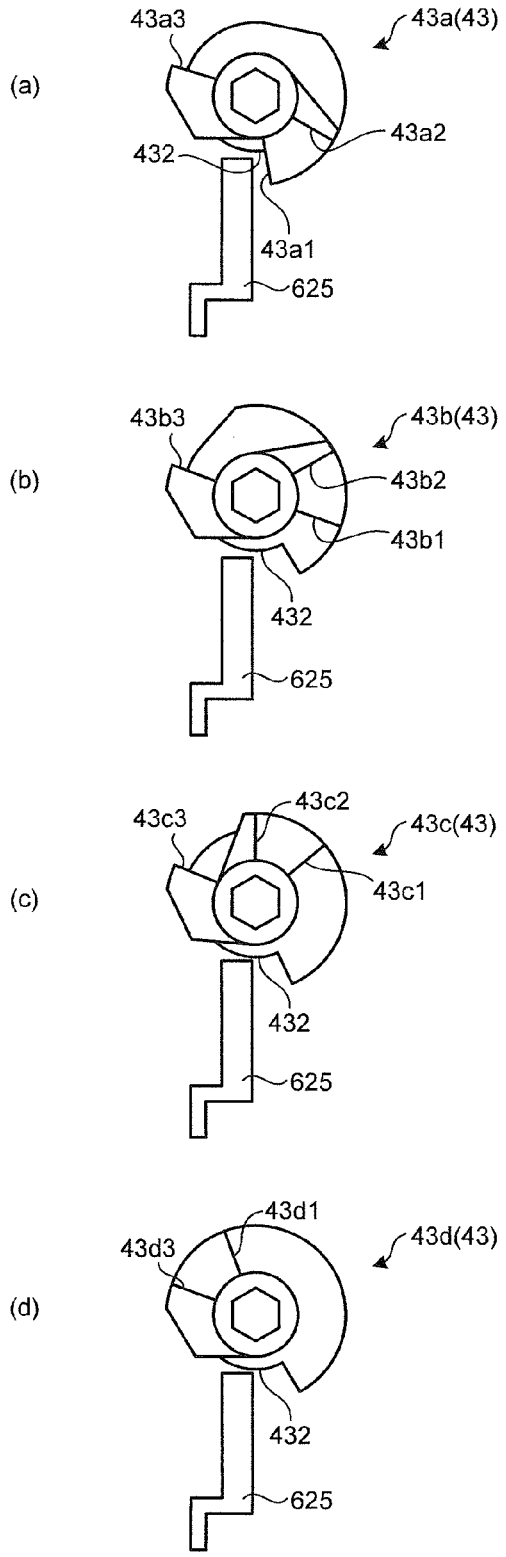
FIGS. 20(*a*) to 20(*d*) are explanatory drawings, each illustrating relation between the switching cam member in a "standby position" and a slide plate and a link slide member.

The position "standby position" is a position serving as standard, in which the standby parts 432 of the switching cam members 43 face the front, as illustrated in (a) to (d) of FIG. 20. In this case, in the standby position, none of the switching cam members 43 contact the slide plate 62 or the link slide member 74.

Figure 21:
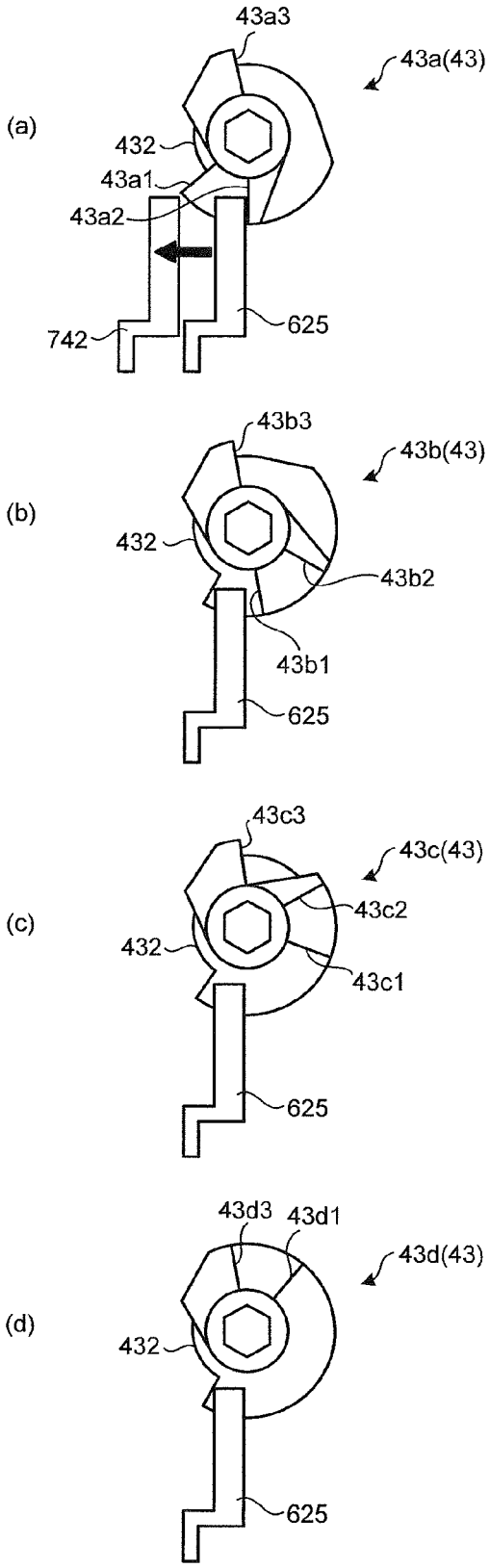
FIGS. 21(*a*) to 21(*d*) are explanatory drawings, each illustrating relation between the switching cam member in a "60° rotated position" and the slide plate and the link slide member.

The position "60° rotated position" is a position in which the support rod 41 is rotated from the "standby position" by 60° clockwise. As illustrated in (a) of FIG. 21, in such a position, the first projecting piece 43*a*1 of the first switching cam member 43*a* abuts on the link slide abutting part 742 in the uppermost product rack 30*a*, to move the link slide abutting part 742 leftward. As illustrated in (b) to (d) of FIG. 21, none of the second switching cam member 43*b*, the third switching cam member 43*c*, and the fourth switching cam member 43*d* abut on the slide plate 62 or the link slide member 74.

Figure 22:
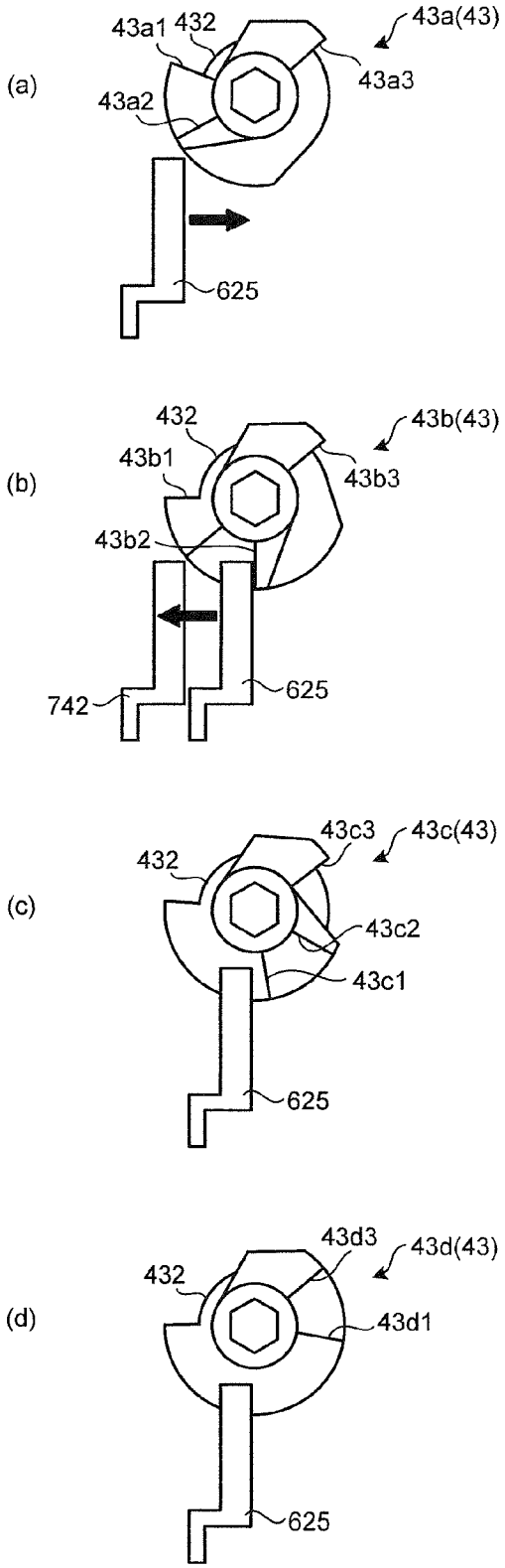
FIGS. 22(*a*) to 22(*d*) are explanatory drawings, each illustrating relation between the switching cam member in a "120° rotated position" and the slide plate and the link slide member.

The position "120° rotated position" is a position in which the support rod 41 is rotated from the "standby position" by 120° clockwise. As illustrated in (b) of FIG. 22, in such a position, the first projecting piece 43*b*1 of the second switching cam member 43*b* abuts on the link slide abutting part 742 in the second product rack 30*b* from the uppermost rack, to move the link slide abutting part 742 leftward. As illustrated in (a) of FIG. 22, the second projecting piece 43*a*2 of the first switching cam member 43*a* abuts on the link slide abutting part 742 and the slide abutting part 625, to move them leftward, on the way of reaching the "120° rotated position". As illustrated in (c) and (d) of FIG. 22, neither the third switching cam member 43*c* nor the fourth switching cam member 43*d* abuts on the slide plate 62 or the link slide member 74.

Figure 23:
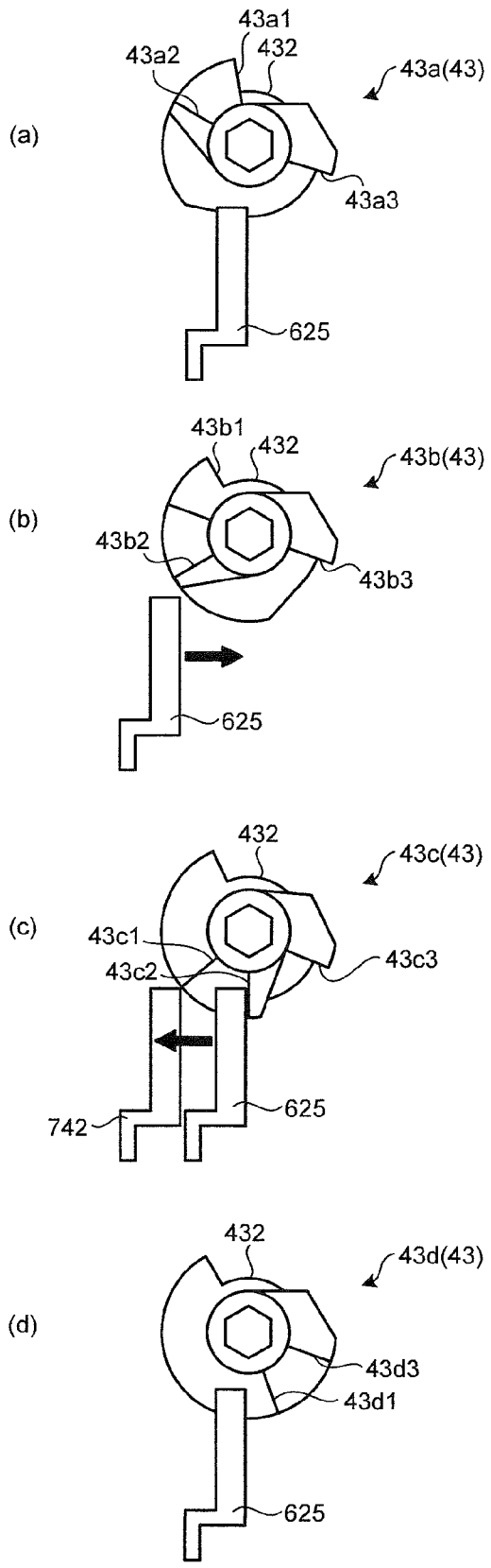
FIGS. 23(*a*) to 23(*d*) are explanatory drawings, each illustrating relation between the switching cam member in a "180° rotated position" and the slide plate and the link slide member.

The position "180° rotated position" is a position in which the support rod 41 is rotated from the "standby position" by 180° clockwise. As illustrated in (c) of FIG. 23, in such a position, the first projecting piece 43*c*1 of the third switching cam member 43*c* abuts on the link slide abutting part 742 in the third product rack 30*c* from the uppermost rack, to move the link slide abutting part 742 leftward. As illustrated in (b) of FIG. 23, the second projecting piece 43*b*2 of the second switching cam member 43*b* abuts on the link slide abutting part 742 and the slide abutting part 625, to move them leftward, on the way of reaching the "180° rotated position". As illustrated in (a) and (d) of FIG. 23, neither the first switching cam member 43*a* nor the fourth switching cam member 43*d* abuts on the slide plate 62 or the link slide member 74.

Figure 24:
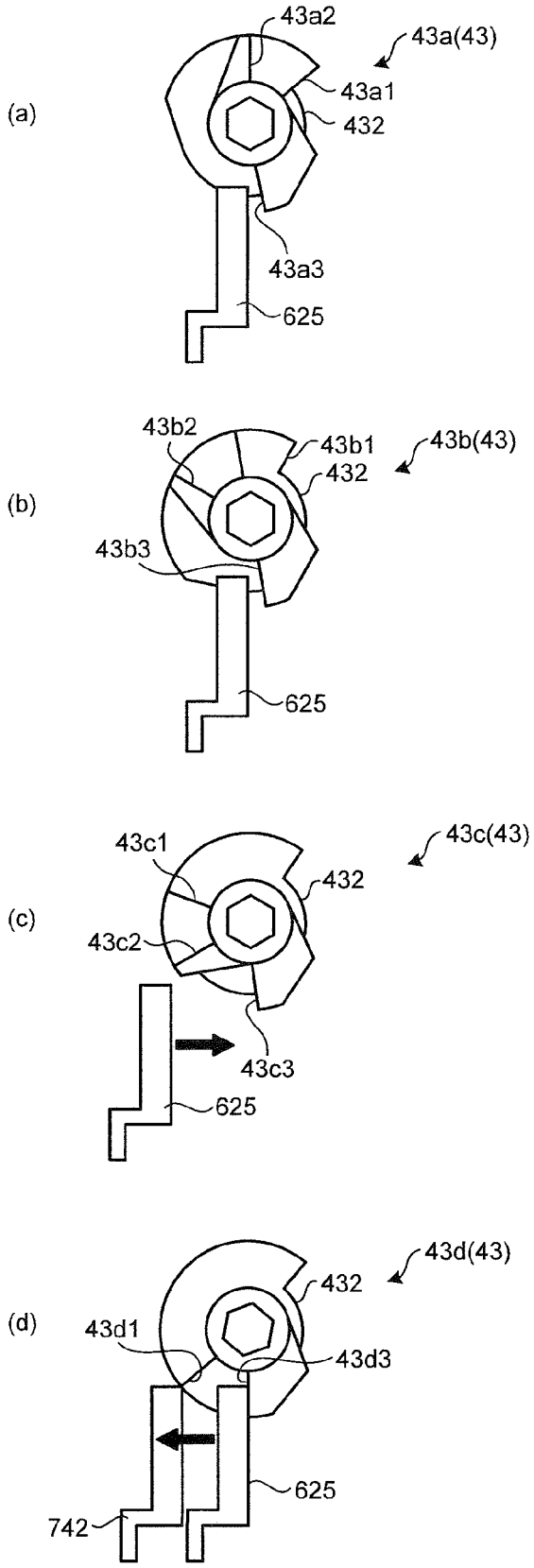
FIGS. 24 (a) to 24(*d*) are explanatory drawings, each illustrating relation between the switching cam member in a "240° rotated position" and the slide plate and the link slide member.

The position "240° rotated position" is a position in which the support rod 41 is rotated from the "standby position" by 240° clockwise. As illustrated in (d) of FIG. 24, in such a position, the first projecting piece 43*d*1 of the fourth switching cam member 43*d* abuts on the link slide abutting part 742 in the lowermost product rack 30*d*, to move the link slide abutting part 742 leftward. As illustrated in (c) of FIG. 24, the second projecting piece 43*c*2 of the third switching cam member 43*c* abuts on the link slide abutting part 742 and the slide abutting part 625, to move them leftward, on the way of reaching the "240° rotated position". As illustrated in (a) and (b) of FIG. 24, neither the first switching cam member 43*a* nor the second switching cam member 43*b* abuts on the slide plate 62 or the link slide member 74.

The position "300° rotated position" is a position in which the support rod 41 is rotated from the "standby position" by 300° clockwise. As illustrated in (a) to (d) of FIG. 25, in such a position, the third projecting pieces 43*a*3, 43*b*3, 43*c*3, and 43*d*3 of all the switching cam members 43 abut on the slide abutting parts 625 and the link slide abutting parts 742 in the respective product racks 30*a* to 30*d*, to move them leftward.

When the support rod 41 is rotated from the "300° rotated position" to the "standby position" again, the slide plate 62 and the link slide member 74 return to the standard position.

FIG. 26 is a flowchart illustrating main processing details of a selling control process executed by the controller 100 illustrated in FIG. 2. The following describes the operation of the vending machine including the above product storage device 20, as well as describing the selling control process.

In the selling control process, when the inserted sum of money (sum information) supplied from the money processor 16 is equal to or greater than the product price (Yes at Step S101), the controller 100 makes the corresponding rack selection buttons 13 effective (Step S102).

When the rack selection button 13 associated with the uppermost product rack 30*a* is pressed and operated among the rack selection buttons 13 made effective (Yes at Step S103), the controller 100 causes the light source 13*a* included in the pressed rack selection button 13 to emit light in accordance with a predetermined pattern (Step S104). At Step S104, the light source 13*a* is caused to continuously emit light. After Step S104 is executed, the controller 100 drives the motor M, recognizing that a selling instruction is provided (Step S105).

When the mode detection switch 4 detects the "60° rotated position" (Yes at Step S106), the controller 100 stops driving the motor M, and causes the light source 13*a* that has been caused to continuously emit light at Step S104 to emit light in accordance with a predetermined pattern, such as blinking (Step S107, Step S108).

Figure 27:
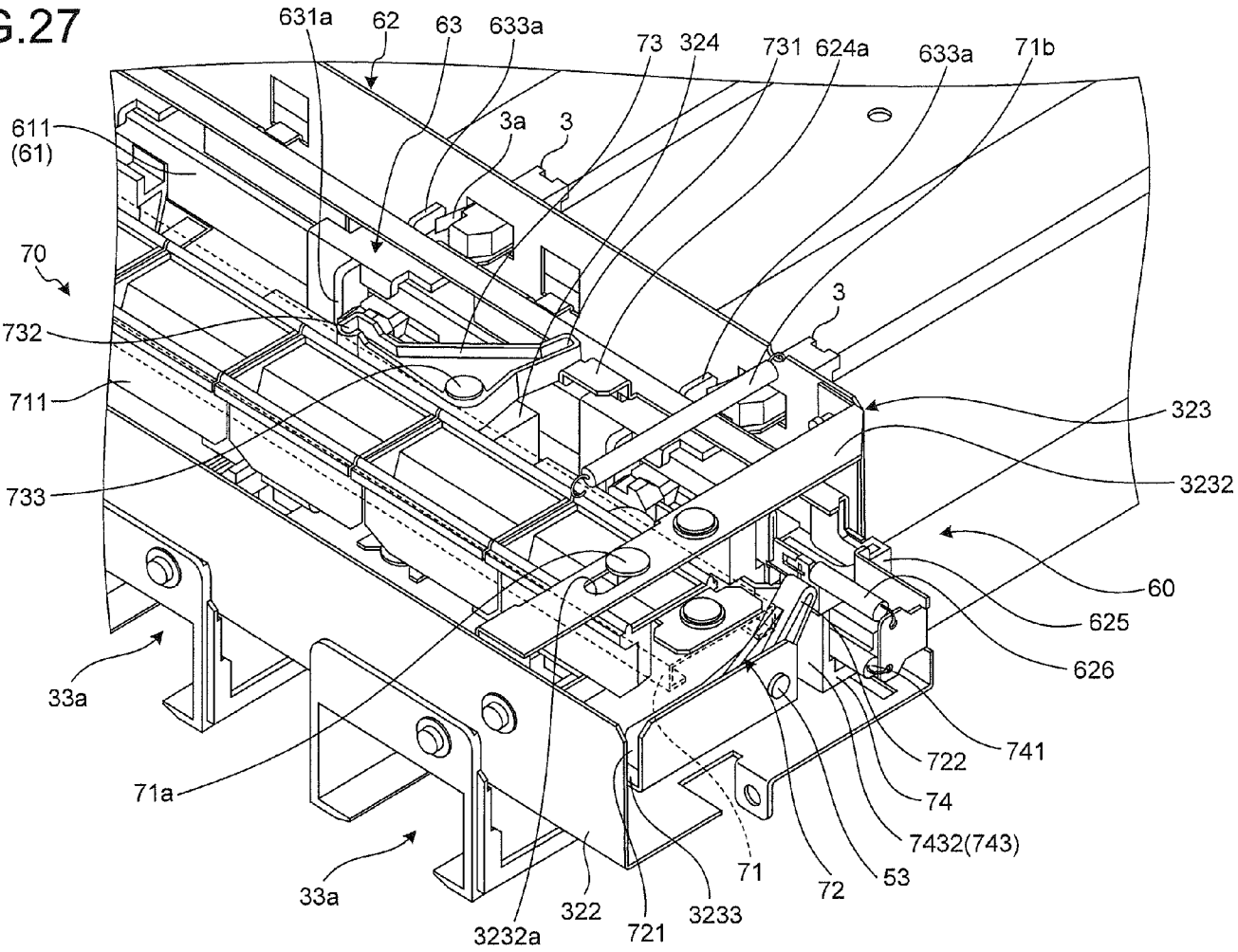
FIG. 27 is a perspective view of a main part of the product rack as viewed obliquely from right front.

Because it is stopped at the "60° rotated position", the support rod 41 is rotated from the "standby position" by 60° clockwise, and the first projecting piece 43*a*1 of the first switching cam member 43*a* abuts on the link slide abutting part 742. In this manner, the link slide member 74 is moved leftward against the urging force of the link slide spring member 741, as illustrated in FIG. 27.

When the link slide member 74 is moved leftward as described above, the inclined abutting part 7432 of the link slide member 74 abuts on the first link member 72, and consequently the front part 721 of the first link member 72 is rotated downward against the urging force of the first link spring member 723. In this manner, the front part 721 of the first link member 72 is withdrawn from the housing region 71*c* of the guide member 71, and consequently the total width of the spaces S1 and S2 in the housing region 71*c* of the guide member 71 becomes greater than the width of the projection 512*b* as illustrated in (a) of FIG. 18, from the state (the state illustrated in (b) of FIG. 18) of being smaller than the width of the projection 512*b* of the main gate member 51. In this manner, the main gate member 51 of each extracting mechanism 50 in the uppermost product rack 30*a* is enabled to rotate upward although it is urged by the gate spring member 54.

In the meantime, in the product racks 30*b* to 30*d* other than the uppermost product rack 30*a*, the switching cam members 43 (second switching cam member 43*b*, third switching cam member 43*c*, and fourth switching cam member 43*d*) attached to the height levels corresponding to the respective product racks 30*b* to 30*d* do not abut on the link slide abutting part 742. Accordingly, in the product racks 30*b* to 30*d* other than the uppermost rack, the total width of the spaces S1 and S2 in the housing region 71*c* of the guide member 71 is in a state of smaller than the width of the projection 512*b* of the main gate member 51, which prevents extraction of the product stored in each product storage column 33 in the product racks 30*b* to 30*d*.

The following operation is performed, when the user performs an extracting operation of pulling out forward the forefront product stored in, for example, the first product storage column 33 from the right in the product rack 30*a* and in a position in which the upper part of the product inclined downward.

First, in the front end rail part 342, because a part of the left long hole part 3421*a*2 where the left raised part 3421*a*1 is formed in the substantially central region of the left front end edge part 3421*a* is elastically deformed until abutting on the left projection 3421*a*3, and a part of the right long hole part 3422*a*2 where the right raised part 3422*a*1 is formed in the substantially central region of the right front end edge part 3422*a* is elastically deformed until abutting on the right projection 3422*a*3, the width L1 between the left and right raised parts 3421*a*1 and 3422*a*1 becomes greater than the maximum width of the neck part 202, to allow movement of the forefront product.

Figure 28:
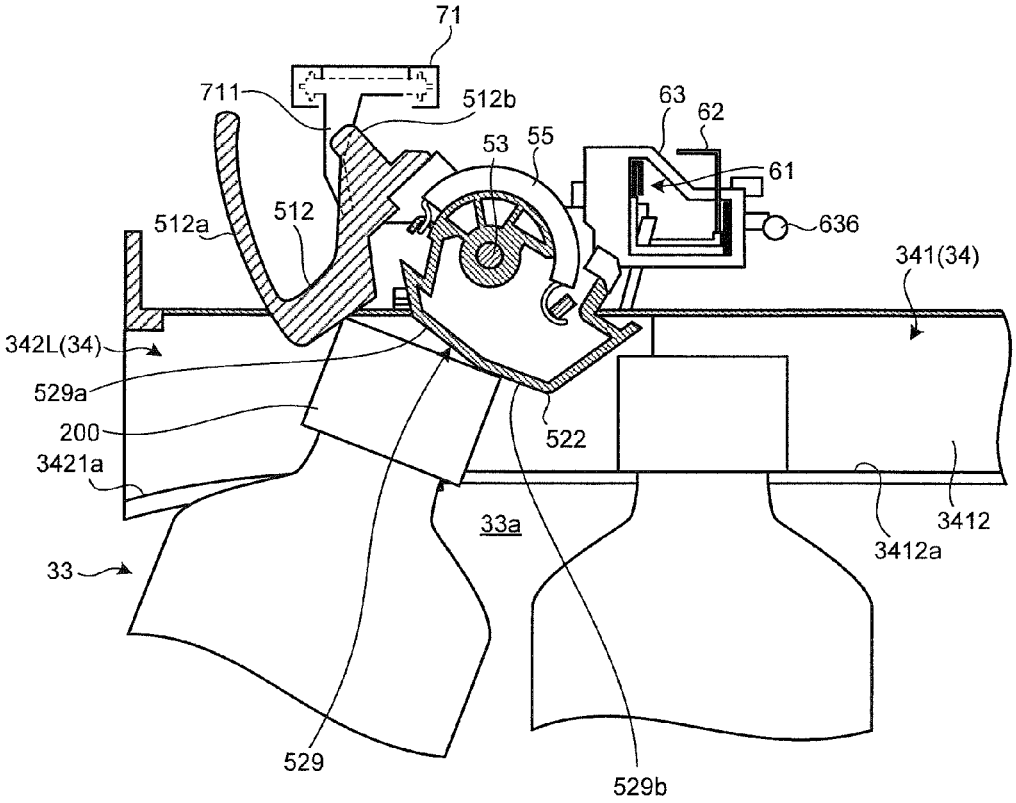
FIG. 28 is a vertical cross-sectional view illustrating the product storage column forming the product rack as viewed from right.
Figure 29:
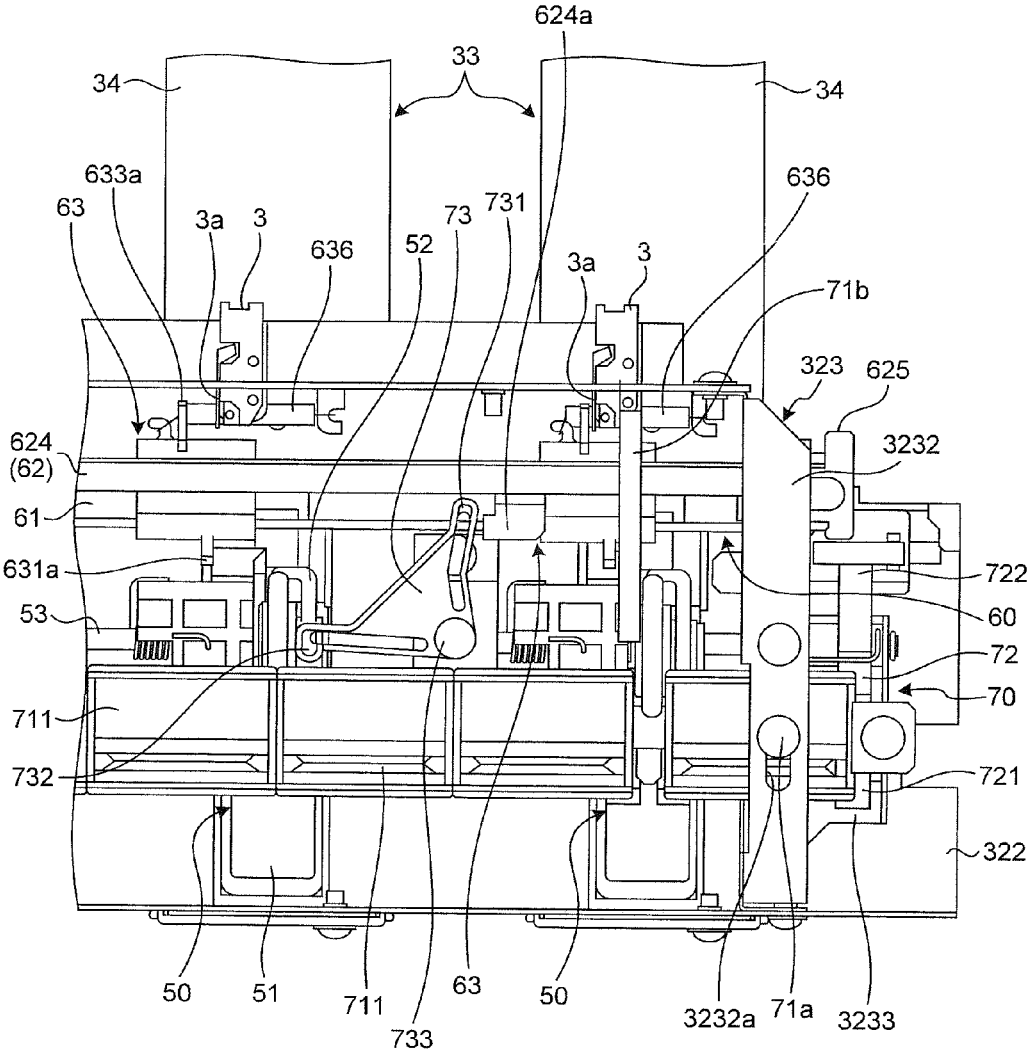
FIG. 29 is a plan view illustrating the main part of the product rack.

In addition, as illustrated in FIG. 28 and FIG. 29, the main gate member 51 that is abutted on the forefront product by extracting operation is rotated upward against the gate spring member 54 such that the first distal end part 512 is retreated from the product storage path 33*a*. In this case, the sub-gate member 52 including the pressing part 529 abutting on the cap 200 of the forefront product also follows change in the position of the forefront product, and is rotated downward in a form in which the second distal end part 522 enters the product storage path 33*a* together with the main gate member 51.

As described above, when the sub-gate member 52 is rotated downward, that is, when the sub-gate member 52 enters the product storage path 33*a*, the second pressing surface 529*b* of the pressing part 529 abutting on the cap 200 of the forefront product presses the forefront surface forward.

Thereafter, the second distal end part 522 of the sub-gate member 52 is located between the extracted forefront product and the second product from the forefront.

As described above, the main gate member 51 is rotated upward, the sub-gate member 52 is rotated, and consequently the lock member 63 is urged by the lock spring member 636 and moved rightward. Next, the projecting piece 631*a* of the lock member 63 is located above the second engaging piece 523 of the sub-gate member 52, whereby the sub-gate member 52 is maintained in a position of being rotated downward. In this manner, the main gate member 51 is also maintained in a position of being rotated upward. Accordingly, the products stored behind the second product from the forefront cannot be moved forward, which restrains extraction of a plurality of products forward in the same product storage column 33.

In addition, the projection 512*b* of the first distal end part 512 in the main gate member 51 rotated upward enters the housing region 71*c* of the guide member 71, as illustrated in (c) of FIG. 18. This prevents the projections 512*b* of the main gate members 51 of the extracting mechanisms 50 provided in the other product storage columns 33 in the uppermost product rack 30*a* from entering the housing region 71*c* of the guide member 71 by virtue of presence of the piece members 711, and consequently the main gate members 51 cannot be rotated upward. This structure suppresses extraction of the products from the other product storage columns 33 in the same product racks 30*a* to 30*d*.

As a result of the operation of extracting the forefront product as described above, when the lock member 63 is urged by the lock spring member 636 and moved rightward, the lock action piece 633*a* presses the contact 3*a* of the corresponding extraction detection switch 3. In this manner, the extraction detection switch in the off state is turned on to supply a turn-on signal to the controller 100.

When a turn-on signal is supplied from the extraction detection switch within a predetermined time (Yes at Step S109, No at Step S110), the controller 100 turns off the light source 13*a* that has been caused to blink and emit light (Step S111). Thereafter, the controller 100 supplies an extraction instruction output to the money processor 16, to supply a cancel instruction to the motor M to drive it (Step S112, Step S113).

The money processor 16 supplied with the extraction instruction output from the controller 100 dispenses change to the coin return port 17 when the change exists, and contains money corresponding to the product price for each type of money.

In addition, the motor M is driven to rotate the support rod 41 clockwise to the "standby position" serving as the predetermined stopping position.

By the rotation of the support rod 41, the second projecting piece 43*a*2 connecting with the first projecting piece 43*a*1 in the first switching cam member 43*a* also abuts on the slide abutting part 625. In this manner, the slide plate 62 is moved leftward against the urging force of the slide spring member 626. By movement of the slide plate 62 leftward, the lock member 63 is also moved leftward against the urging force of the lock spring member 636, and withdrawn from the region above the sub-gate member 52. This releases the region above the sub-gate member 52. In this manner, the main gate member 51 is urged by the gate spring member 54 to be rotated downward, and the sub-gate member 52 is also rotated upward. In addition, the first distal end part 512 of the main gate member 51 enters the product storage path 33*a*, and the second distal end part 522 of the sub-gate member 52 is retreated from the product storage path 33*a*.

Thereafter, when the support rod 41 is rotated to cancel abutment between the second projecting piece 43*a*2 of the first switching cam member 43*a* and the slide abutting part 625 and the link slide abutting part 742, the slide plate 62 and the link slide member 74 are urged by the slide spring member 626 and the link slide spring member 741 to move rightward and return to the original state. In this manner, the first link member 72 abuts on the horizontal abutting part 7431 of the link slide member 74, and the front part 721 urged by the first link spring member 723 is rotated upward to enter the housing region 71*c* of the guide member 71. In this manner, the total width of the spaces S1 and S2 in the housing region 71*c* of the guide member 71 becomes smaller than the width of the projection 512*b* of the main gate member 51, to restrain entering of the projection 512*b* of the main gate member 51. Specifically, each main gate member 51 cannot be rotated upward.

When the mode detection switch 4 detects a predetermined position, that is, "standby position" (Yes at Step S114), the controller 100 stops driving the motor M (Step S115), and thereafter return the process to end the current process. This structure enables selling of a product selected by the user.

By contrast, when no turn-on signal is supplied from the extraction detection switch 3 within the predetermined time at Step S109 and Step S110 (No at Step S109, Yes at Step S110), the controller 100 turns off the light source 13*a* that has been caused to blink and emit light (Step S116). Next, the controller 100 supplies a non-extraction instruction output to the money processor 16 (Step S117). The money processor 16 supplied with the non-extraction instruction output from the controller 100 dispenses the inserted coins to the coin return port 17.

Next, the controller 100 that has supplied the non-extraction instruction output supplies a cancel instruction to drive the motor M (Step S118). Thereafter, the controller 100 executes the processing of Step S114 and Step S115 described above, and returns the process to end the current process.

Figure 30:
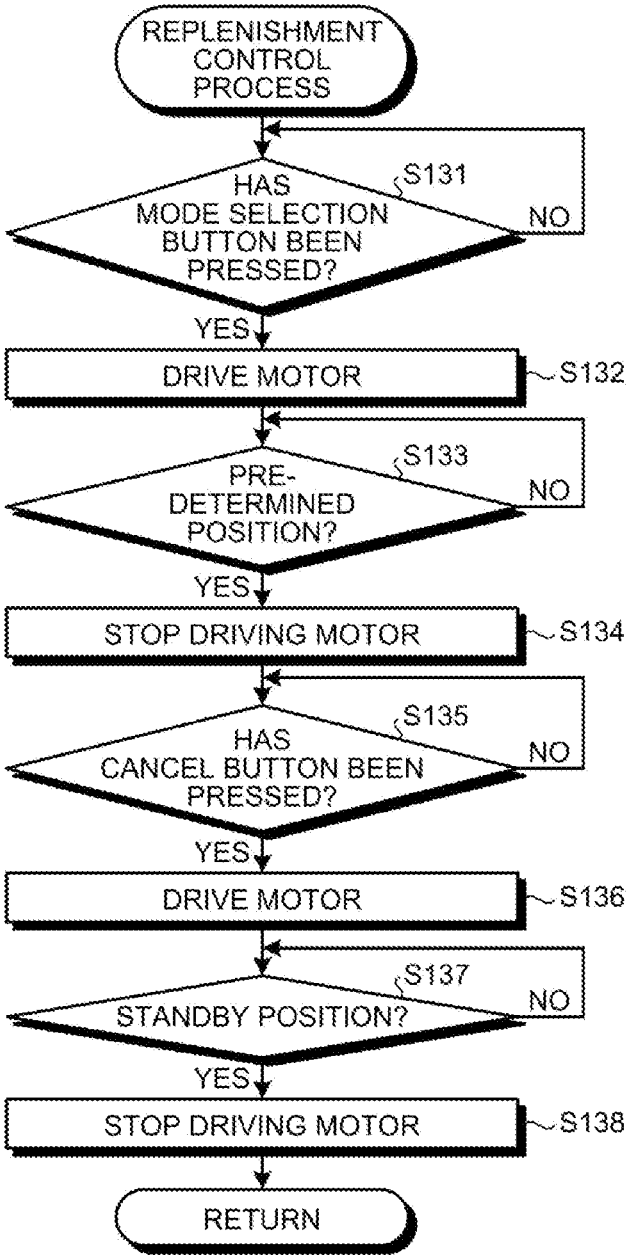
FIG. 30 is a flowchart illustrating main processing details of a replenishment control process executed by the controller illustrated in FIG. 2.

Next, the following describes the case of replenishing products in the above vending machine. FIG. 30 is a flowchart illustrating main processing details of a replenishment control process executed by the controller 100 illustrated in FIG. 2. The following is an explanation of the case of replenishing products in the vending machine including the above product storage device 20, together with the explanation of the replenishment control process.

In the replenishment control process, when the manager presses to operate the mode selection button 14 (Yes at Step S131), the controller 100 determines that a replenishment instruction is provided and drives the motor M (Step S132).

When the mode detection switch 4 detects the "300° rotated position" as the predetermined position (Yes at Step S133), the controller 100 stops driving the motor M (Step S134).

Figure 25:
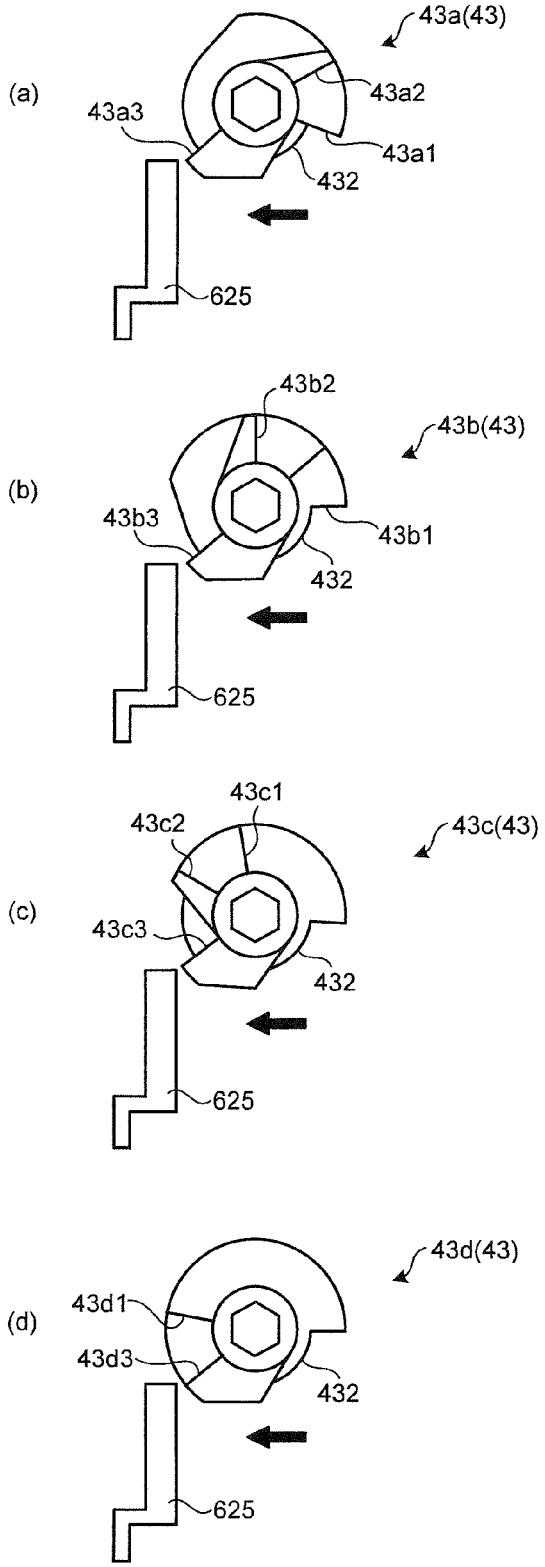
FIGS. 25(*a*) to 25(*d*) are explanatory drawings, each illustrating relation between the switching cam member in a "300° rotated position" and the slide plate and the link slide member.

In the "300° rotated position", the third projecting pieces 43*a*3, 43*b*3, 43*c*3, and 43*d*3 of all the switching cam members 43 abut on the slide abutting part 625 and the link slide abutting part 742 of the link slide member 74 in each of the product racks 30*a* to 30*d*, to maintain them in a state of being moved leftward, as explained with reference to FIG. 25.

Figure 31:
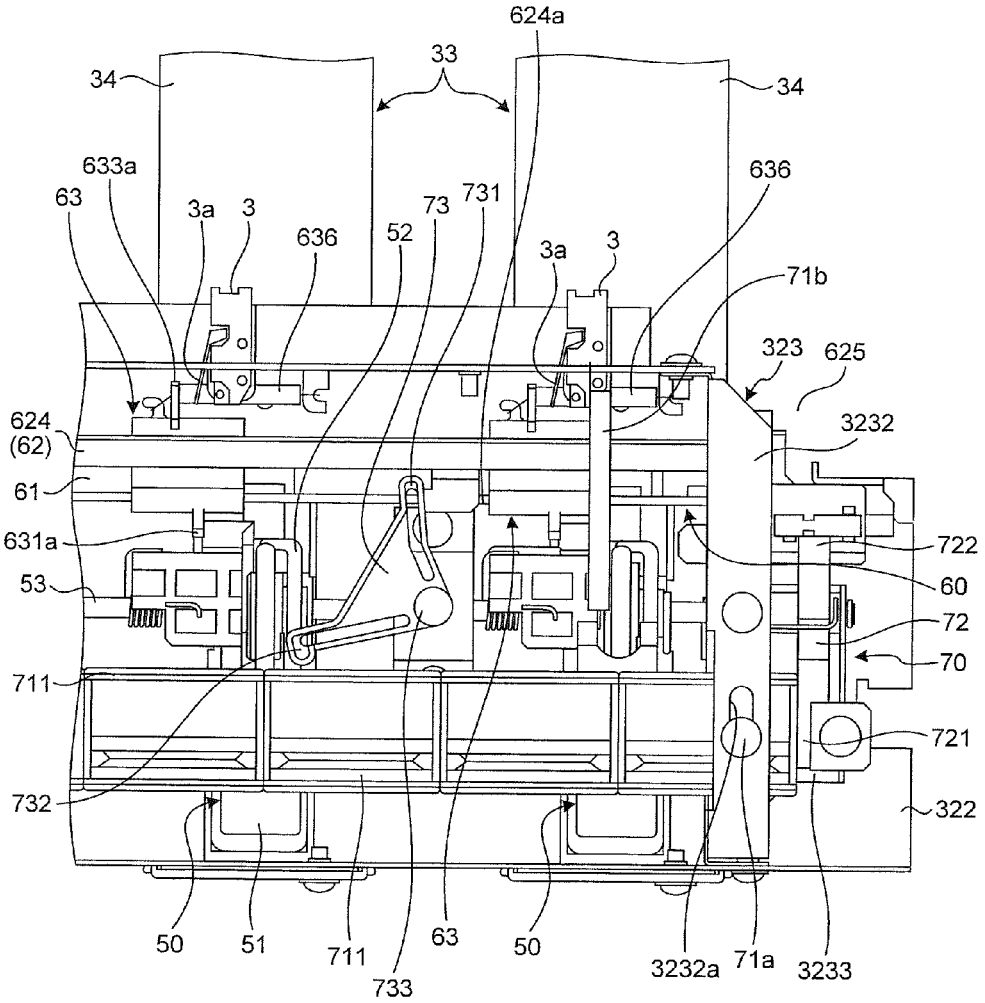
FIG. 31 is a plan view illustrating the main part of the product rack.

Because the link slide member 74 is moved leftward from the standard position as described above, the inclined abutting part 7432 of the link slide member 74 abuts on the first link member 72, which enables the front part 721 of the first link member 72 to be rotated downward against the urging force of the first link spring member 723. In this manner, the front part 721 of the first link member 72 is withdrawn from the housing region 71*c* of the guide member 71. In addition, by moving the slide plate 62 leftward from the standard position, the slide action piece 624*a* is also moved leftward. This movement rotates the second link member 73 around the central axis of the link shaft part 733, and the second link end part 732 presses the guide member 71 forward. As a result, as illustrated in FIG. 31, the guide member 71 is moved forward from the standard position against the urging force of the guide spring member 71*b*, and positioned in a position in which the housing region 71*c* of the guide member 71 is withdrawn from the rotation locus of the projections 512*b* of the main gate members 51. By withdrawing the housing region 71*c* of the guide member 71 from the rotation locus of the projections 512*b* of the main gate members 51, all the main gate members 51 of the extracting mechanism 50 are enabled to rotate upward. Specifically, it is enabled to simultaneously replenish all the product storage paths 33*a* (product storage columns 33) with products.

Figure 32:
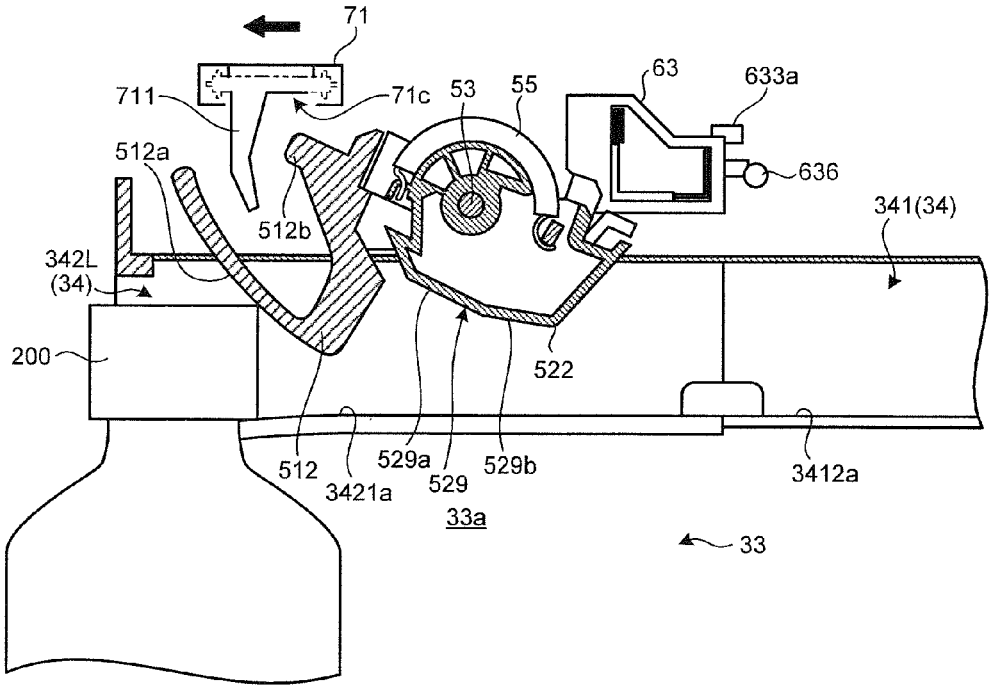
FIG. 32 is a vertical cross-sectional view illustrating the product storage column forming the product rack, as viewed from right.

Next, as illustrated in FIG. 32, replenishing products are put into the product storage path 33*a* from the front. When the replenishing product is put into the product storage path 33*a* like this, the cap 200 of the replenishing product abuts on the sliding part 512*a* in the first distal end part 512 of the main gate member 51, to slide the sliding part 512*a*. In this case, because the sliding part 512*a* of the main gate member 51 forms a curved surface, the main gate member 51 is rotated upward by being pressed by the replenishing product. In this manner, the sub-gate member 52 is rotated downward in response to rotation of the main gate member 51.

Consequently, the put product abuts on the pressing part 529 of the sub-gate member 52. Because the sub-gate member 52 is not restrained from rotating by the lock member 63, the sub-gate member 52 is rotated upward against the urging force of the coil spring member 55, and the second distal end part 522 is retreated from the product storage path 33*a*. This structure enables putting products of a predetermined number of bottles from the front region of the product storage column 33 to perform replenishment.

Also in this case, in the front end rail part 342, a part of the left long hole part 3421*a*2 where the left raised part 3421*a*1 is formed in the substantially central region of the left front end edge part 3421*a* is elastically deformed until abutting on the left projection 3421*a*3, and a part of the right long hole part 3422*a*2 where the right raised part 3422*a*1 is formed in the substantially central region of the right front end edge part 3422*a* is elastically deformed until abutting on the right projection 3422*a*3, the width L1 between the left and right raised parts 3421*a*1 and 3422*a*1 becomes greater than the maximum width of the neck part 202, to allow movement and replenishment of products.

After the manager replenishes products of a predetermined number of bottles, when the manager presses to operate the cancel button 15 (Yes at Step S135), the controller 100 supplies a cancel instruction to the motor M to drive the motor M (Step S136).

Next, when the mode detection switch 4 detects the predetermined position, that is, the "standby position" (Yes at Step S137), the controller 100 stops driving the motor M (Step S138), and thereafter returns the process to end the current process.

In the above product storage device 20, the main gate member 51 provided to be rotatable in a form of going into and out of the product storage path 33*a* in each product storage column 33 enters the product storage path 33*a* in the normal state to be positioned in front of (downstream) the forefront product (most downstream product), while allowing the forefront product to be extracted when the main gate member 51 is retreated from the product storage path 33*a*. In addition, the restraint mechanism 70 including the guide member 71 extending along the direction in which the product storage columns 33 are arranged and a plurality of piece members 711 stored in the housing region 71*c* of the guide member 71 to be slidable along the extending direction of the guide member 71 makes, in the normal state, the total width of the spaces in the housing region 71*c* smaller than the width of the projection 512*b* of the main gate member 51 by causing the front part 721 of the first link member 72 to enter the housing region 71*c*, to restrain all the main gate members 51 from being retreated from the product storage path 33*a*. By contrast, when extraction of a product is allowed in one of the product racks 30*a* to 30*d*, the restraint mechanism 70 makes the total width of the spaces in the housing region 71*c* greater than the width of the projection 512*b* by causing the front part 721 of the first link member 72 to be withdrawn from the housing region 71*c*, to allow one of the main gate members 51 to be retreated from the product storage path 33*a* and restrain the other main gate members 51 from being retreated from the product storage path 33*a*. This structure enables suppression of extraction of a plurality of products by the user by one extracting operation, without a bucket driving unit used in a conventional product storage device, when selling in any of the product racks 30*a* to 30*d* is allowed. Accordingly, this structure prevents extraction of a plurality of products from one of the product racks 30*a* to 30*d* by one extraction operation, with reduction in cost aimed.

In addition, when replenishment of products is allowed in either of the product racks 30*a* to 30*d*, because the restraint mechanism 70 causes the guide member 71 to be moved to a position of being withdrawn from the rotation locus of the projection 512*b* in the main gate member 51 to allow all the main gate members 51 to be retreated from the product storage path 33*a*, it is enabled to simultaneously replenish all the product storage paths 33*a* (product storage columns 33) with products. Besides, because the count of sales for each product storage column 33 can be managed by detecting a signal of the extraction detection switch 3 provided in each product storage column 33, the efficiency of replenishment of products can be improved.

Besides, with the product storage device 20 serving as the embodiment of the present invention, when the sub-gate member 52 enters the product storage path 33*a*, the pressing part 529 abuts on the forefront product extracted in a position where the upper part is inclined toward upstream, to press the forefront product forward. This structure assists extraction of the forefront product, and enables good extraction of the product located most downstream in a position where the upper part is inclined toward upstream.

With the above product storage device 20, because the pressing part 529 of the sub-gate member 52 abuts on the forefront product when the sub-gate member 52 is retreated from the product storage path 33*a*, the forefront product can be maintained in a desired position.

In addition, in the above product storage device 20, the front end rail part 342 (left front end rail part 342L and right front end rail part 342R) that defines the front end part (downstream end part) of the product storage path 33*a* is gradually inclined downward toward the front. This structure enables the manager who is the replenishment worker to put the products along the product storage path 33*a* formed by the front end rail part 342, when product replenishment is performed, to abut the product on the sliding part 512*a* of the first distal end part 512 of the main gate member 51 to rotate the main gate member 51. Accordingly, the front end rail part 342 functions as the guide member in product replenishment.

Besides, in the above product storage device 20, the left raised part 3421*a*1, the left long hole part 3421*a*2, and the left projection 3421*a*3 in the left front end rail part 342L, and the right raised part 3422*a*1, the right long hole part 3422*a*2, and the right projection 3422*a*3 in the right front end rail part 342R form a restraining unit that is narrower in the normal state than the neck part (202) of the product to restrain the forefront product from passing therethrough forward, and is elastically deformed to be wider than the neck part (202) by being pressed by the forefront product, to allow the forefront product to pass therethrough, when the forefront product is extracted. Because the restraining unit in the normal state restrains the forefront product from passing therethrough forward as described above, the product stored in the product storage path 33*a* is stored in a state of being movable forward by its own weight, by attaching the rail member 34 in a state of being gradually inclined downward toward the front. However, because the forefront product between the raised parts 3421*a*1 and 3422*a*1 is restrained from moving, there is no fear that the load of the stored products acts on the main gate member 51. This structure removes the need to increase the strength of the main gate member 51 more than required.

Although the preferred embodiment of the present invention has been described above, the present invention is not limited to it, but may be variously changed as follows.

Figure 33:
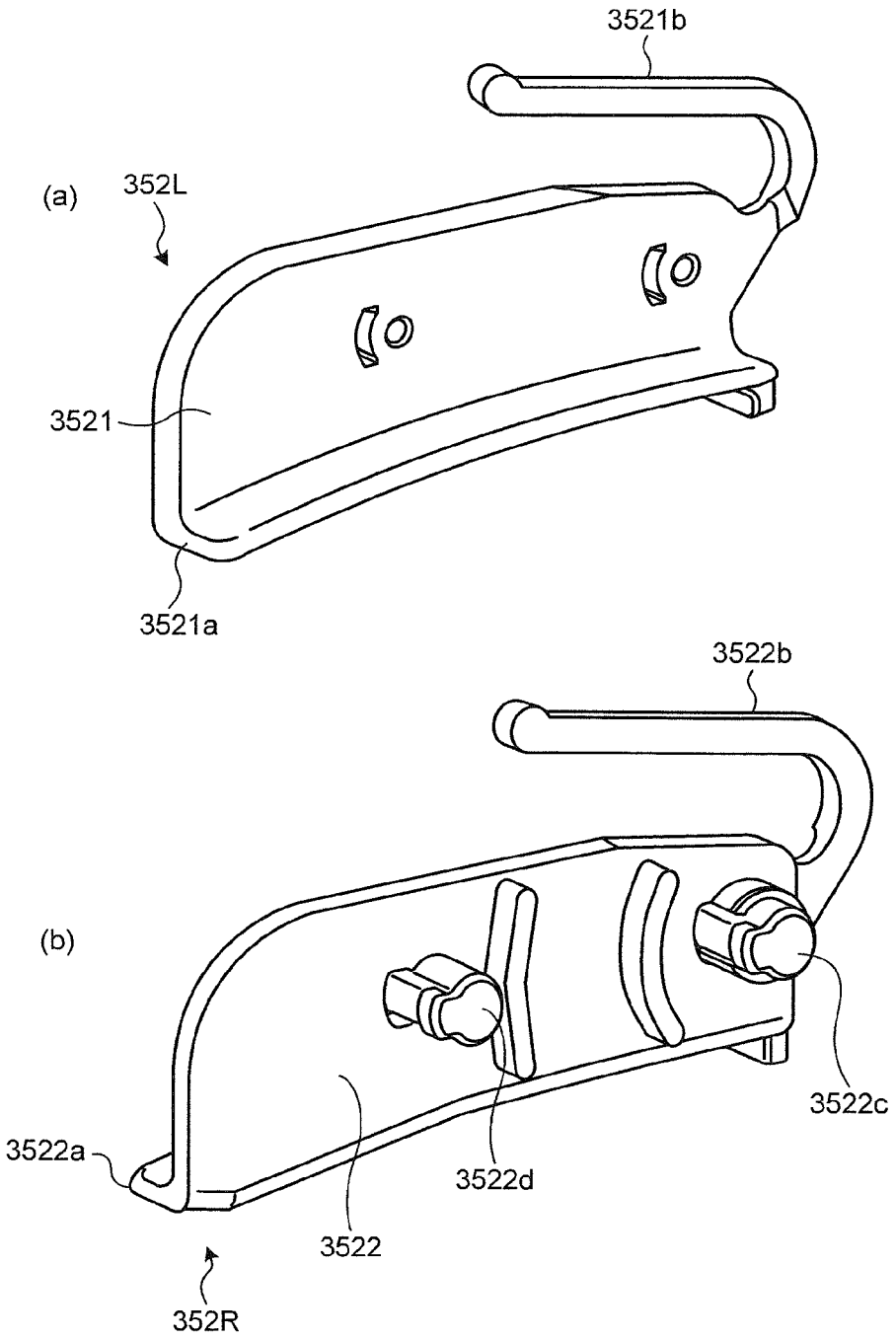
FIGS. 33(*a*) and 33(*b*) illustrate modifications of the front end rail part serving as the embodiment of the present invention, (a) being a perspective view of a left front end rail part and (b) being a perspective view of a right front end rail part.

FIG. 33 illustrates a modification of the front end rail part serving as the embodiment of the present invention, (a) being a perspective view of the left front end rail part and (b) being a perspective view of the right front end rail part.

A left front end rail part 352L is formed of a resin material, and has a structure in which a front end left base part 3521 and a left front end edge part 3521*a* are formed as one unitary piece, to have an L shape as viewed from front. The front end left base part 3521 is a flat plate part extending in the vertical direction. A rear end part of the front end left base part 3521 is provided with a left rail spring member 3521*b* that is bent upward and also bent forward, and thereafter gradually inclined upward toward the front. The left front end edge part 3521*a* is formed by bending the lower end part of the front end left base part 3521 rightward.

Figure 34:
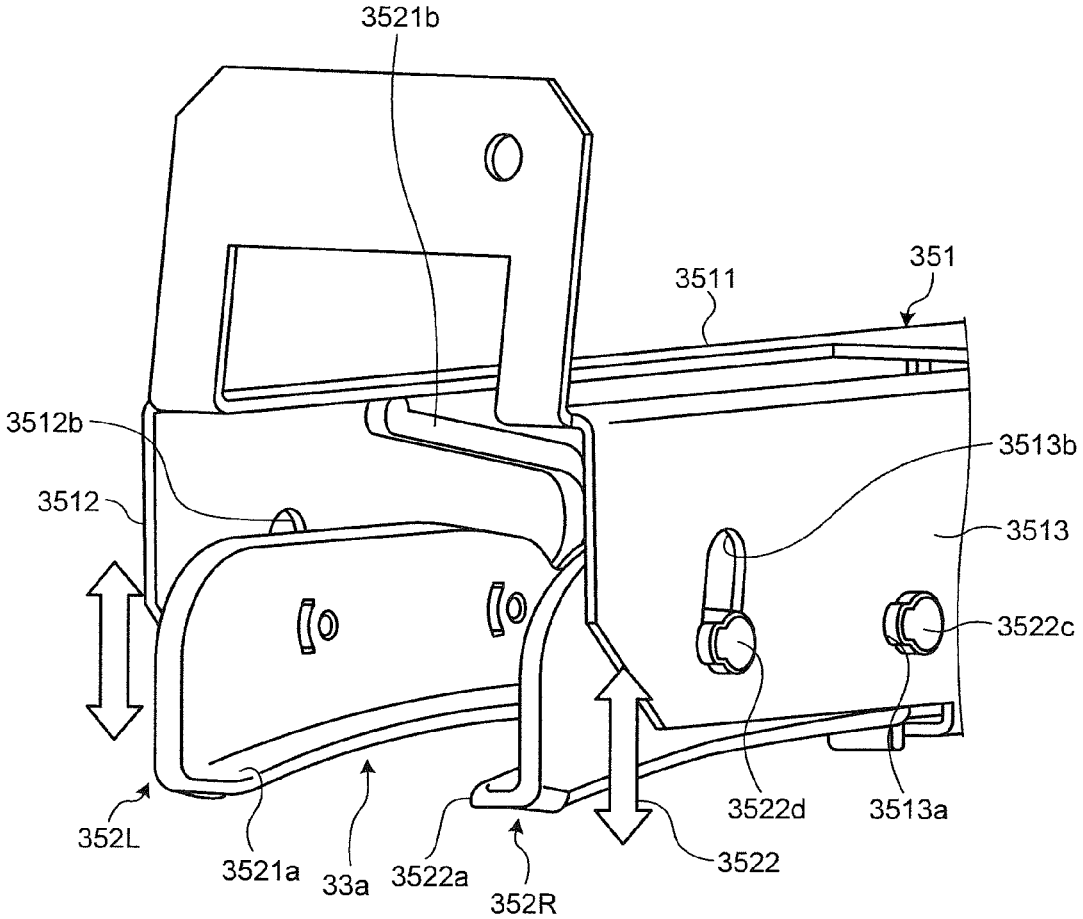
FIG. 34 is a perspective view illustrating a main part of the product storage column with the front end rail part illustrated in FIGS. 33(*a*) and 33(*b*).

The left front end rail part 352L as described above enters a front end part of a rail base member 351 and attached to the rail base member 351. More specifically, as illustrated in FIG. 34, a rear engaging projection among a pair of front and rear engaging projections (not illustrated) provided to project leftward from the left surface of the front end left base part 3521 is inserted into a left standard hole (not illustrated) formed in a left lower extending part 3512 of the rail base member 351, the front engaging projection is inserted into a left arc-shaped long hole 3512*b* formed around the left standard hole serving as the center, and an extending end part of the left rail spring member 3521*b* abuts on the lower surface of a base part 3511 of the rail base member 351.

A right front end rail part 352R forms a right-and-left pair with the left front end rail part 352L, and is formed of a resin material. The right front end rail part 352R has a structure in which a front end right base part 3522 and a right front end edge part 3522*a* are formed as one unitary piece, to have an inverted L shape as viewed from front. The front end right base part 3522 is a flat plate part extending in the vertical direction. A rear end part of the front end right base part 3522 is provided with a right rail spring member 3522*b* that is bent upward and also bent forward, and thereafter gradually inclined upward toward the front. The right front end edge part 3522*a* is formed by bending the lower end part of the front end right base part 3522 leftward.

The right front end rail part 352R as described above enters the front end part of the rail base member 351 to be attached to the rail base member 351. More specifically, as illustrated in FIG. 34, a rear engaging projection 3522*c* among a pair of front and rear engaging projections 3522*c* and 3522*d* provided to project rightward from the right surface of the front end right base part 3522 is inserted into a right standard hole 3513*a* formed in a right lower extending part 3513 of the rail base member 351, the front engaging projection 3522*d* is inserted into a right arc-shaped long hole 3513*b* formed around the right standard hole 3513*a* serving as the center, and an extending end part of the right rail spring member 3522*b* abuts on the lower surface of the base part 3511 of the rail base member 351.

The left front end rail part 352L and the right front end rail part 352R attached to the front end part of the rail base member 351 as described above define the front end part (downstream end part) of the product storage path 33*a* with a space between them, and are gradually inclined downward toward the front.

The left front end rail part 352L and the right front end rail part 352R having the above structures are individually elastically displaced vertically by elastic restoring force of the left rail spring member 3521*b* and the right rail spring member 3522*b*. In this manner, the front end rail parts are capable of following the extraction position of the most downstream product (most downstream product), and enables extraction of the most downstream product in a desired position.

Figure 35:
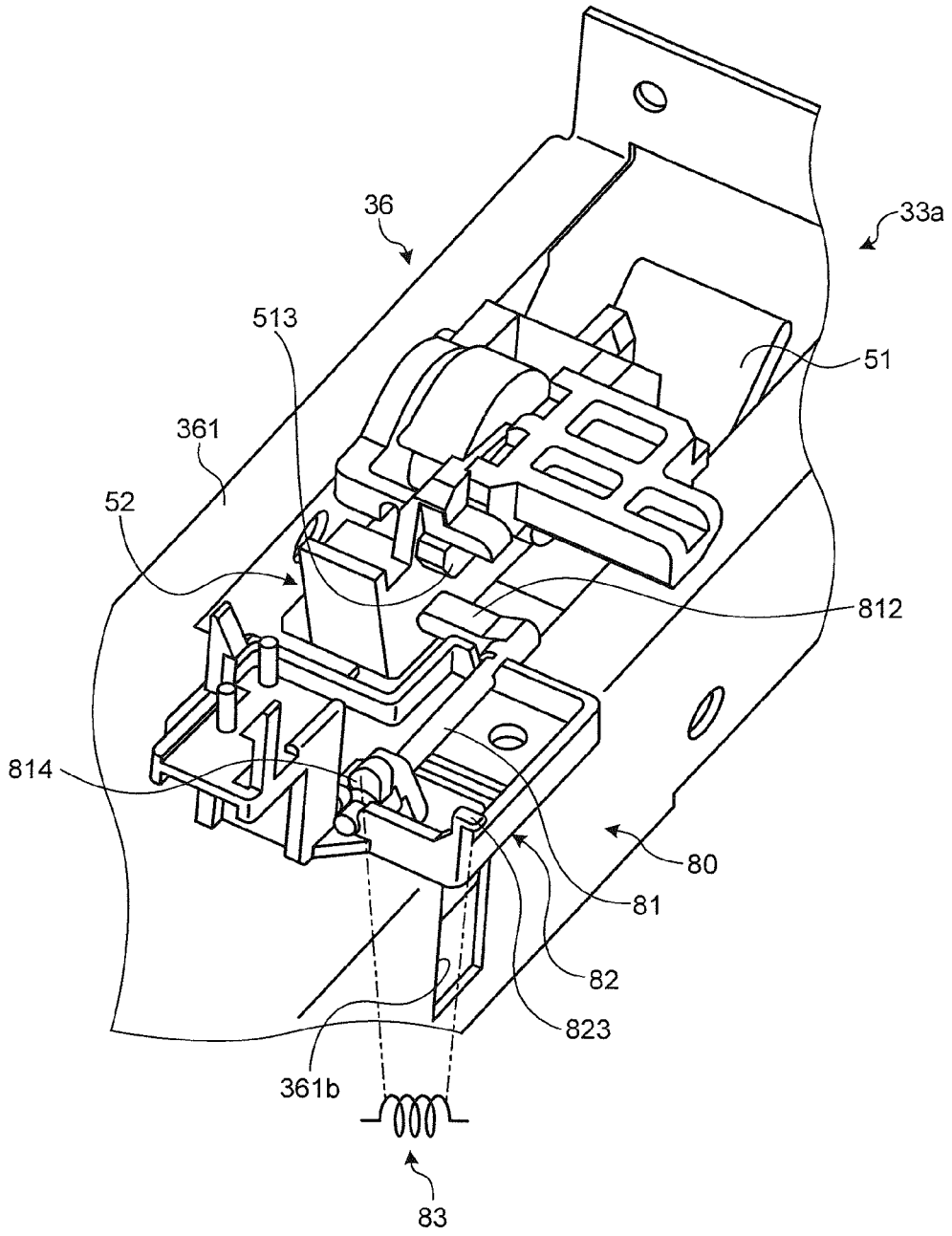
FIG. 35 is a perspective view illustrating a main structure of a modification of the product storage device serving as the embodiment of the present invention.

FIG. 35 is a perspective view illustrating a main structure of a modification of the product storage device according to the embodiment of the present invention. The product storage device illustrated herein has a structure in which a rail base member 361 of a rail member 36 defining the product storage column is provided with a shutter mechanism 80. The shutter mechanism 80 includes a shutter member 81 and an attachment base 82.

Figure 36:
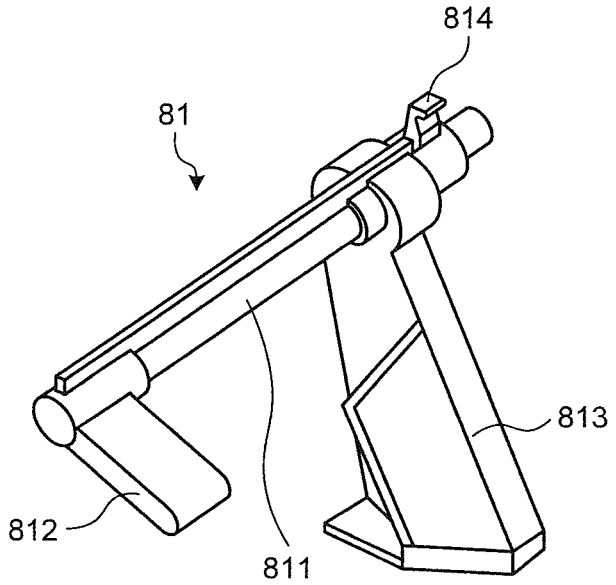
FIG. 36 is a perspective view illustrating a shutter member forming a shutter mechanism illustrated in FIG. 35.

As illustrated in FIG. 36, the shutter member 81 is formed of a resin material, and includes a shutter shaft part 811 having one end provided with an abutting part 812 and the other end with a shutter main body part 813. A reference numeral 814 in FIG. 36 denotes a shutter engaging piece.

Figure 37:
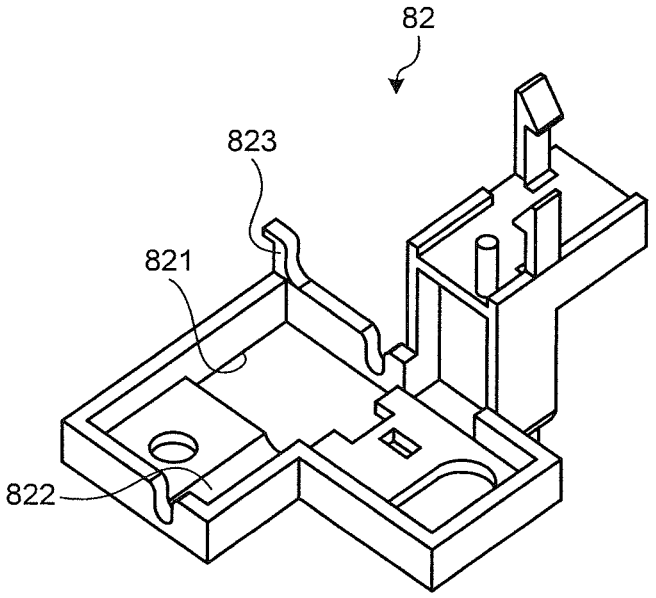
FIG. 37 is a perspective view illustrating an attachment base forming the shutter mechanism illustrated in FIG. 35.

As illustrated in FIG. 37, the attachment base is formed of a resin material, and provided with a shutter opening 821 through which the shutter member 81 is inserted.

The shutter mechanism 80 as described above is formed by attaching the attachment base 82 to a predetermined part of the rail base member 361, and arranging the shutter member 81 in a state where the shutter main body part 813 extends through the shutter opening 821 of the attachment base 82 and the shutter shaft part 811 enters an attachment groove 822 of the attachment base 82.

In addition, as illustrated in FIG. 35, a shutter spring 83 serving as an urging unit is interposed between the shutter engaging piece 814 and an attachment engaging piece 823 of the attachment base 82, whereby the shutter member 81 is urged by the shutter spring 83 and the shutter main body part 813 enters the product storage path 33*a*. In this case, the shutter main body part 813 enters a region behind the sub-gate member 52, that is, between the forefront product in the product storage path 33*a* and the second product adjacent to the rear of the forefront product, and the abutting part 812 is located in a region below the first engaging piece 513 of the main gate member 51.

The shutter member 81 as described above in the normal state enters the product storage path 33*a* by being urged by the shutter spring 83 to restrain the second product from moving downstream. This structure prevents the load of the second product and the following products from acting on the forefront product.

Figure 38:
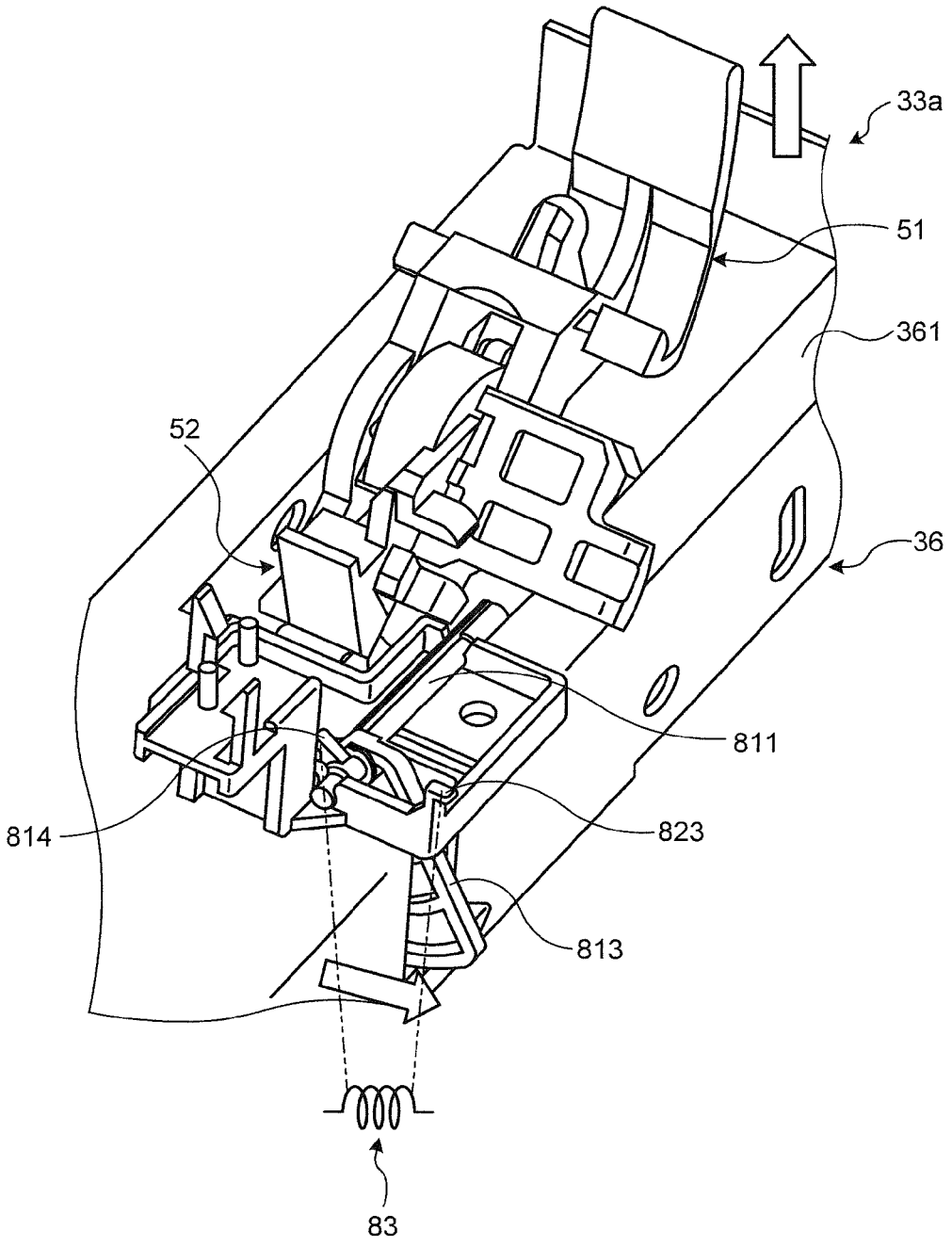
FIG. 38 is a perspective view illustrating a main structure of a modification of the product storage device serving as the embodiment of the present invention.

When the main gate member 51 is rotated upward to be retreated from the product storage path 33*a* by operation of extracting the forefront product, the abutting part 812 abuts on the first engaging piece 513 of the main gate member 51 as illustrated in FIG. 38, whereby the shutter member 81 is rotated around the central axis of the shutter shaft part 811 against the urging force of the shutter spring 83, and retreated from the product storage path 33*a* via a cutoff opening 361*b* formed in the rail base member 361. In this manner, the second product can be moved forward (downstream).

As described above, the shutter member 81 is rotatably provided in a form of moving forward and backward with respect to the product storage path 33*a*, and urged in the normal state by the shutter spring 83 to enter the product storage path 33*a* to restrain the second product from moving downstream. By contrast, when the main gate member 51 is retreated from the product storage path 33*a*, the shutter member 81 is retreated from the product storage path 33*a* against the urging force of the shutter spring 83 by abutting the abutting part 812 on the main gate member 51, to allow the second product to move downstream.

With the product storage device having the above structure, because the shutter member 81 restrains the second product from moving downstream, the load of the second product and the following product is prevented from acting on the most downstream product.

The present invention is not limited to the preferred embodiment and modification of the present invention that have been explained above, but may be variously changed.

Although the pressing part 529 of the sub-gate member 52 in the above embodiment abuts on the most downstream product serving as the most downstream product when the pressing part 529 enters the product storage path 33*a*, the pressing part may not abut on the most downstream product when the pressing part enters the product storage path in the present invention.

Figure 39:
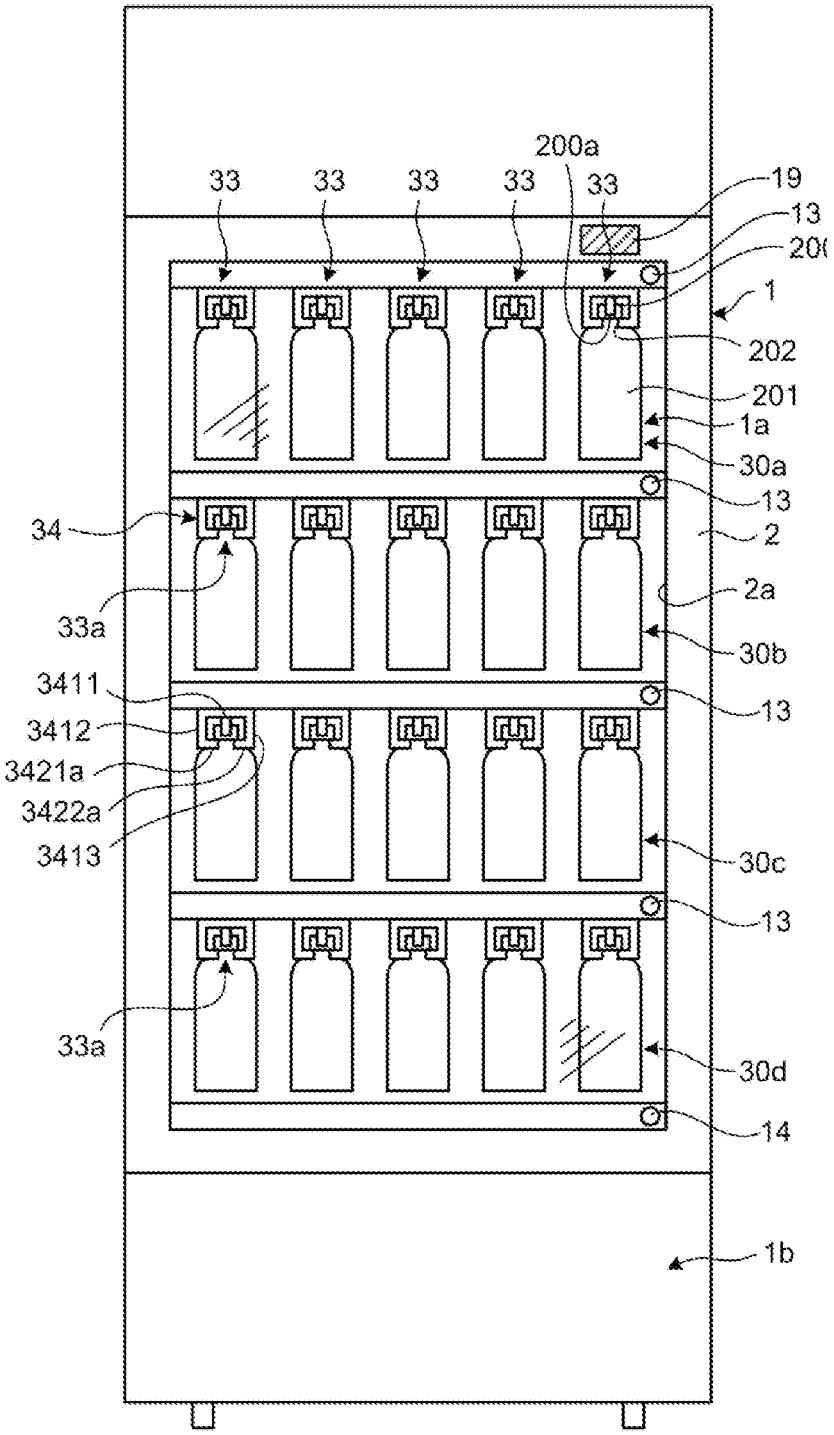
FIG. 39 is a front view illustrating a modification of the vending machine to which the product storage device serving as the embodiment of the present invention is applied.

Although the above embodiment illustrates the vending machine in which the input processing unit 10 includes the money processor 16 to perform a selling process in response to insertion of coins, the vending machine to which the product storage device according to the present invention is applied may include a reader/writer unit 19 in the main cabinet 1 without the input processing unit, as illustrated in FIG. 39, to perform a product selling process in response to a predetermined card held over the reader/writer unit 19. In the case of adopting such a vending machine, the rack selection buttons 13 may be provided in predetermined positions in upper front parts of the respective product racks 30*a* to 30*d* in the main cabinet 1, for example, and the mode selection button 14 may be provided in a predetermined position in a lower front part of the lowermost product rack 30*d*. This structure removes the need to provide any input processing unit, and enables reduction in space of the vending machine.

REFERENCE SIGNS LIST

1 main cabinet
2 external door
20 product storage device
30*a* product rack
30*b* product rack
30*c* product rack
30*d* product rack
31 rack support side plate
33 product storage column

33*a* product storage path
34 rail member
342 front end rail part
342*l* left front end rail part
342*r* right front end rail part
3421 front end left base part
3421*a* left front end edge part
3422 front end right base part
3422*a* right front end edge part
3421*a*1 left raised part
3421*a*2 left long hole part
3421*a*3 left projection
3422*a*1 right raised part
3422*a*2 right long hole part
3422*a*3 right projection
40 rack selection mechanism
41 support rod
43 switching cam member
50 extracting mechanism
51 main gate member
511 first base end part
512 first distal end part
52 sub-gate member
521 second base end member
522 second distal end member
529 pressing part
529*a* first pressing surface
529*b* second pressing surface
53 gate shaft part
54 gate spring member
55 coil spring member
60 support mechanism
61 fixed plate
62 slide plate
63 lock member
70 restraint mechanism
71 guide member
711 piece member
72 first link member
73 second link member
74 link slide member
100 controller
M motor

The invention claimed is:

1. A product storage device comprising:

a product rack including a plurality of product storage columns arranged side by side, the product storage column having a product storage path storing products in a row;

a main gate member provided in each of the product storage columns to be rotatable in a form of moving into or out of the product storage path, the main gate member in a normal state being maintained in a state of entering the product storage path to be located on a downstream side of a most downstream product, the main gate member allowing the most downstream product to be subjected to extraction operation and extracted when the main gate member is released from the state of entering the product storage path and retreated from the product storage path; and a restraining unit including a guide member extending along a direction of arranging the product storage columns; a plurality of piece members slidably housed in a housing region of the guide member along the extending direction of the guide member; and an adjusting member provided in a manner moving into or out of the housing region, the restraining unit in a normal state causing the adjusting member to enter the housing region to set a total width of spaces in the housing region smaller than a width of an enterable part of the main gate member and restrain all the main gate members from being retreated from the product storage path, the restraining unit causing the adjusting member to be withdrawn from the housing region to set the total width of the spaces in the housing region greater than the width of the enterable part when extraction of a product in the product rack is allowed, to allow any one main gate member to be retreated from the product storage path and restrain the other main gate members from being retreated from the product storage path.

2. The product storage device according to claim 1, wherein the restraining unit moves the guide member to a position in which the guide member is withdrawn from a rotation locus of the enterable part in the main gate member to allow all the main gate members to be retreated from the product storage path when replenishment of products in the product rack is allowed.

3. The product storage device according to claim 1, further comprising:

a sub-gate member provided to be rotatable in connection with the main gate member in a form of moving into or out of the product storage path, the sub-gate member being retreated from the product storage path when the main gate member is maintained in the state of entering the product storage path, the sub-gate member entering the product storage path to restrain a second product adjacent to an upstream side of the most downstream product from moving downstream when the main gate member is retreated from the product storage path, wherein the sub-gate member includes a pressing part abutting on the most downstream product to be extracted in a position in which an upper part of the pressing part is inclined upstream, to press the most downstream product downstream when the pressing part enters the product storage path.

4. The product storage device according to claim 3, wherein the pressing part of the sub-gate member abuts on the most downstream product when the sub-gate member is retreated from the product storage path.

5. The product storage device according to claim 3, further comprising:

a shutter member provided to be rotatable in a form of moving into and out of the product storage path, the shutter member in a normal state entering the product storage path to restrain the second product from moving downstream by urging of an urging unit, the shutter member being retreated from the product storage path against an urging force of the urging unit to allow the second product to move downstream by abutting at an abutting part of the shutter member on the main gate member when the main gate member is retreated from the product storage path.

6. The product storage device according to claim 1, wherein each of the product storage columns includes a rail member extending along the product storage path and supporting a product having a neck part between a cap attachment part to which a cap is detachably attached and a body part, in a state of being suspended in a standing position by supporting the cap attachment part of the product, and the rail member is curved in a form where a downstream end part is gradually inclined downward toward downstream.

7. The product storage device according to claim 6, wherein the downstream end part includes a restraining part that is narrower than the neck part, and the restraining part in a normal state restrains the most downstream product from passing through the restraining part toward downstream, and the restraining part is elastically deformed to be wider than the neck part to allow passage of the most downstream product by receiving a pressing force from the most downstream product when the most downstream product is subjected to extraction operation.

8. The product storage device according to claim 6, wherein the rail member includes:

a metal rail base member supporting the products in a state of being suspended substantially horizontally from upstream toward downstream; and a pair of right and left resin lower end rail parts forming the downstream end part and attached to a lower end part of the rail base member, and each of the lower end rail parts is provided to be elastically deformable along the vertical direction with respect to the rail base member.

* * * * *